US007576700B2

(12) United States Patent
Oshima et al.

(10) Patent No.: US 7,576,700 B2
(45) Date of Patent: Aug. 18, 2009

(54) ON-BOARD ANTENNA DEVICE

(75) Inventors: Hideaki Oshima, Minato-ku (JP); Hiroshi Iijima, Minato-ku (JP); Tomoki Ikeda, Ota-ku (JP); Norio Tanaka, Ota-ku (JP)

(73) Assignee: Nippon Sheet Glass Company Limited, Tokyo (JP)

( * ) Notice: Subject to any disclaimer, the term of this patent is extended or adjusted under 35 U.S.C. 154(b) by 142 days.

(21) Appl. No.: 11/805,370

(22) Filed: May 23, 2007

(65) Prior Publication Data

US 2007/0279306 A1 Dec. 6, 2007

(30) Foreign Application Priority Data

May 30, 2006 (JP) ..... 2006-149345

(51) Int. Cl.
*H01Q 1/32* (2006.01)

(52) U.S. Cl. ..... 343/713; 343/700 MS

(58) Field of Classification Search ..... 343/713, 343/700 MS, 841, 711
See application file for complete search history.

(56) References Cited

U.S. PATENT DOCUMENTS 5,400,039 A * 3/1995 Araki et al. ..... 343/700 MS
6,522,291 B1 2/2003 Noguchi et al.
7,248,222 B2 * 7/2007 Iijima et al. ..... 343/700 MS
2002/0029893 A1 3/2002 Toyoda et al.
2005/0225489 A1 10/2005 Aizawa et al.
2008/0297422 A1 * 12/2008 Ishida ..... 343/702

FOREIGN PATENT DOCUMENTS

| | | |
|---|---|---|
| EP | 1 617 508 | 1/2006 |
| EP | 1 633 015 | 3/2006 |
| JP | 2006013957 | 1/2006 |
| WO | WO 99/63317 | 12/1999 |

OTHER PUBLICATIONS

European Search Report Jul. 31, 2007.

* cited by examiner

*Primary Examiner*—HoangAnh T Le
(74) *Attorney, Agent, or Firm*—RatnerPrestia

(57) ABSTRACT

An on-board antenna device, comprises a radiation element (22) formed on an inner-surface of a window glass (51) for a vehicle (50), a base plate (405) having an opening, the base plate (405) being fixed on the inner-surface of the window glass (51) so as to surround the radiation element (22), and a housing (27) assembled onto the base plate (405), the housing (27) having an opening surrounding the radiation element, wherein the base plate has four leakage prevention walls (405*b*, 405*c*, 405*d* and 405*e*) and each of four leakage prevention walls (405*b*, 405*c*, 405*d* and 405*e*) has a surface substantially parallel to each of four sidewalls (430*b*, 430*c*, 430*d* and 430*e*) of the housing (27).

5 Claims, 15 Drawing Sheets

Conventional stracture

Inventive structure

ON-BOARD ANTENNA DEVICE

TECHNICAL FIELD

The present invention relates to an on-board antenna device, particularly to an on-board antenna device formed on a window glass for a vehicle.

RELATED ART

Conventionally, an on-board antenna device for a vehicle is known, in which the on-board antenna device enables to receive circularly-polarized wave or linearly-polarized wave transmitted from a satellite or an ground station by forming a radiation element on a inner-surface of a window glass, for example a rear glass, in the vehicle interior and arranging an electronic circuit unit on the inner-surface, the electronic circuit unit including a pre-amplifier. This type of an on-board antenna device has an advantageous effect, for example long-life of the on-board antenna device and lower risk of the theft of the on-board antenna device, compared with an on-board antenna device formed on an outside of a vehicle, such as a roof thereof. Moreover, the type of the on-board antenna device has an advantageous effect of a widely viewing angle for a driver of the vehicle, compared with an antenna arrangement placed in the adjacent location of the window glass in the vehicle interior.

In the type of the on-board antenna device, it is composed so that the electronic circuit unit formed on inner-surface of the window glass, for example the rear glass or a front glass, in the vehicle interior may contain a circuit board including a pre-amplifier, etc. in a housing of the electronic circuit unit. Moreover, the radiation element, having a predefined shape, formed on the window glass may be electrically connected to the circuit board through a feeder cable etc. for feeding to the radiation element and receiving an incoming signal.

The example of the prior art is now described referring to drawings. Each of FIGS. 17A and 17B is a plan view showing the fixing location of an antenna unit for a vehicle. FIG. 17A is a side view of a vehicle, and FIG. 17B is a plan view of a rear glass observed from a vehicle interior.

As shown in is FIGS. 17A and 17B, the antenna unit for the vehicle is composed of a set of an on-board antenna device 100 for an ground station and an on-board antenna device 200 for a satellite which are formed on the inner-surface of the rear glass 51 for the vehicle 50. The electromagnetic radiation of linearly-polarized wave (vertically-polarized wave) transmitted from the ground station may be received by the on-board antenna device 100 for the ground station, and the electromagnetic radiation of circularly-polarized wave transmitted from the satellite may be received by the on-board antenna device 200 for the satellite. This antenna unit may obtain good sensitivity of several electromagnetic radiations by interactively operating the on-board antenna device 100 and the on-board antenna device 200.

The on-board antenna device 200 for the satellite is now described. The on-board antenna device 200 provided with an antenna unit for a vehicle is shown in FIGS. 18-20. FIG. 18 is perspective view showing an electronic circuit unit of the on-board antenna device for the satellite. FIG. 19 is a plan view showing the arrangement of the on-board antenna device 200 constructed by a base plate of the electronic circuit unit and the radiation element formed on a window glass. FIG. 20 is exploded perspective view of the electronic circuit unit. The on-board antenna device 200 is provided for a patch antenna. The on-board antenna device 200 is mainly composed of an electronic circuit unit 21 formed on the inner-surface of the rear glass 51 in the vehicle interior and a radiation element 22 formed on the inner-surface of the rear glass 51. The electronic circuit unit 21 comprises: a base plate 24 fixed on the inner-surface of the rear glass 51; a circuit board 26 electrically connected to the radiation element 22 and a ground element 23 through a coaxial cable, such as a feeder cable 25; a housing 27 assembled onto the base plate 24 to contain the circuit board 26; a connector cover 32; an output cable 28 (for example, a coaxial cable) in which one end of the output cable 28 is connected to the circuit board 26 while the other end thereof is connected to an external receiver (not shown); and a DC cable 9 for supplying power to a antenna device 100 for a ground station.

In that case, the housing 27 is composed of a square-shaped frame 30 and a cover 31.

The construction of each part of the on-board antenna device 200 for the satellite is described in detail. As shown in FIG. 19, the radiation element 22, which is a patch electrode formed in the substantial square-shape, includes notched shaped isolation elements 22*a* for degeneration formed on both corners in a direction of one diagonal line. The ground element 23, which is a ground electrode formed in the substantial square-shape, surrounds keeping a predetermined space to the radiation element 22. Both of the radiation element 22 and the ground element 23 are conductive layers made of good conductive metal, such as Ag. As shown in FIG. 19, the feeding point of the radiation element 22 is connected to an internal conductor of a feeder cable 25. Moreover, the ground element 23 is connected to an external conductor of the feeder cable 25.

The base plate 24 has a square-shape surrounding an opening 24*a*, on which a plurality of female screws 24*b* are mounted. The frame 30 is fixed to the base plate 24 by clamping each male screw 33 to each of the plurality of female screws 24*b* through each hole of outwardly protruded portions 30*a* of the frame 30. As shown in FIG. 19, the base plate 24 is fixed to the window glass 51 with a humidity-hardening resin 34.

As shown in FIG. 20, the square-shaped frame 30 mainly comprises a pair of opposing sidewalls 30*b* and 30*c* and a pair of opposing sidewalls 30*d* and 30*e*. Outwardly protruded portions 30*a* are designed in both longitudinal-direction-sides of each of the sidewalls 30*b* and 30*c*, respectively. The end of the frame 30, opposing to the rear glass 51, has fitting portions 30*f* to be loosely inserted into the opening 24*a* of the base plate 24. The stoppers 30*g* formed respectively in near each corner of the fitting portions 30*f* are hit to the base plate 24. In this manner, each depth of the fitting portions 30*f* to be inserted into the opening 24*a* is set to be lower than the thickness of the base plate 24. The stopper 30*g* are formed in both longitudinal-direction-sides of the sidewalls 30*b* and 30*c*, respectively, and are protruded at a small amount with respect to the adjacent sidewalls 30*d* and 30*e*. A plurality of small holes 30*h* are designed in adjacent regions of edge portions of the frame 30, in the side opposed to the fitting portions 30*f*.

Each of sidewalls 30*b*-30*e* of the frame 30 comprises tongues 30*j* bent toward the inner-space and through-holes 30*k* formed for the tongues 30*j*, and the circuit board 26 is supported by the tongues 30*j*. In addition, the through-holes 30*k* provided in sidewalls 30*b* function as a hole for pulling out water.

As shown in FIG. 20, one surface of the circuit board 26 is a component mounting surface 26*a* on which various electronic components (not shown) including an amplifier are mounted. One end of the feeder cable 25 is connected to the component mounting surface 26*a* through a pair of connectors 36 and 37, while the other end of the feeder cable 25 is connected to the radiation element 22 and the ground element 23 both. That is, the one end of the feeder cable 25 is connected to the input of the pre-amplifier.

Moreover, one end of each of the coaxial cable 28 and the DC cable 9 are soldered to the component mounting surface 26*a*, and the other end of each of these cables are provided with a connector 38. A plurality of surrounding edge portions of the component mounting surface 26*a* are soldered to the frame 30. Thereby, the frame 30 function as a ground electrically, and the circuit board 26 and the frame 30 are mechanically coupled. The other surface (the reverse surface) of the circuit board 26, i.e. a opposite surface thereof to the radiation element 22 and the ground element 23, is an electromagnetic wave reflecting surface 26*b* on which a conductive layer consisting of a good conductive metal, such as Au, is formed. The surrounding edge portion of the electromagnetic wave reflecting surface 26*b* is supported by means of tongues 30*j* in a plurality of portions of the frame 30.

Such on-board antenna device 200 for a satellite is disclosed as a prior art, for example, in Japanese Patent Application Laid-Open No. 2006-13957.

DISCLOSURE OF THE INVENTION

However, a conventional on-board antenna device has a structure of a square-shaped frame which is composed of the housing and the base plate, wherein the structure is assembled by clamping each male screw 33 to each of the plurality of female screws 24*b* through each hole of outwardly-protruded portions 30*a* of the frame 30 which is a part of the housing 27. Therefore, there is a problem that the structure of the conventional on-board antenna device may cause variation of the antenna performance by assembling-failures or assembling-conditions of the on-board antenna device. That is, the structure has a minute space between the square-shaped frame and the base plate, wherein the minute space may cause to leak the electromagnetic field into external region of the on-board antenna device if the connection between the frame and the base plate becomes loss of electro-conductive or becomes high impedance.

In that case, if the on-board antenna device as shown in FIG. 20 keeps the electro-conductive between the frame 30 and the base plate 24 by means of the stopper 30*g* in enough, it is understood that the leakage of the electromagnetic field does not happen even if the structure has the minute space. However, if the connection between the frame and the base plate becomes loss of electro-conductive or becomes high impedance such that a humidity-hardening resin etc. for assembling is put between the stopper 30*g* of the frame and the opening 24*a* of the base plate, the energy of the electromagnetic field is easy to leak, particularly in which the minute space form a slot having ½ of the wavelength for the satellite broadcasting frequency band (2.3 GHz) for instance.

Consequently, inspecting the electrical connection between the stopper 30*g* of the frame and the opening 24*a* of the base plate is needed in the prior art, thereby the manufacturing cost and the inspecting-cost for assembling might be increased. Therefore, the total cost of the on-board antenna device will be up by the cause of the minute space.

The purpose of the present invention is to solve the above-mentioned problem, and to provide the on-board antenna device with more high quality and more high stability.

An on-board antenna device is provided in accordance with the present invention, which comprises: a radiation element formed on an inner-surface of a window glass for a vehicle; a base plate having an opening, the base plate being fixed on the inner-surface of the window glass so as to surround the radiation element; and a housing assembled onto the base plate, the housing having an opening surrounding the radiation element; wherein the base plate has four leakage prevention walls and each thereof has a surface substantially parallel to each of four sidewalls of the housing. The leakage prevention walls are described later in the detailed description.

Another aspect of an on-board antenna device for indirect-feeding by electro-magnetically coupling a feeding pattern to a radiation element is provided in accordance with the present invention, which comprises: a radiation element formed on an inner-surface of a window glass for a vehicle; a base plate having an opening, the base plate being fixed on the inner-surface of the window glass so as to surround the radiation element; a feeding board having a feeding pattern which is formed on one surface thereof, the feeding pattern being opposed with a predetermined distance to the radiation element; a circuit board including a conductive layer formed across the substantial entire area of one surface thereof which is opposed to the feeding board and a pre-amplifier mounted on the other surface thereof; a small connection board arranged between the feeding board and the circuit board in a vertical direction to the feeding board and the circuit board; and a housing assembled onto the base plate to contain the feeding board, the circuit board and the small connection board in a space surrounded by four sidewalls of the housing; wherein the base plate has four leakage prevention walls and each thereof has a surface substantially parallel to each of the four sidewalls of the housing.

In accordance with the present invention, it may be provided an on-board antenna device with more high quality and more high stability, without depending on the condition of the connection between the housing and the base plate.

BEST MODE FOR CARRYING OUT THE INVENTION

First of all, a first embodiment according to the present invention is now described with the explanation of feature elements thereof.

A First Embodiment

Figure 1:
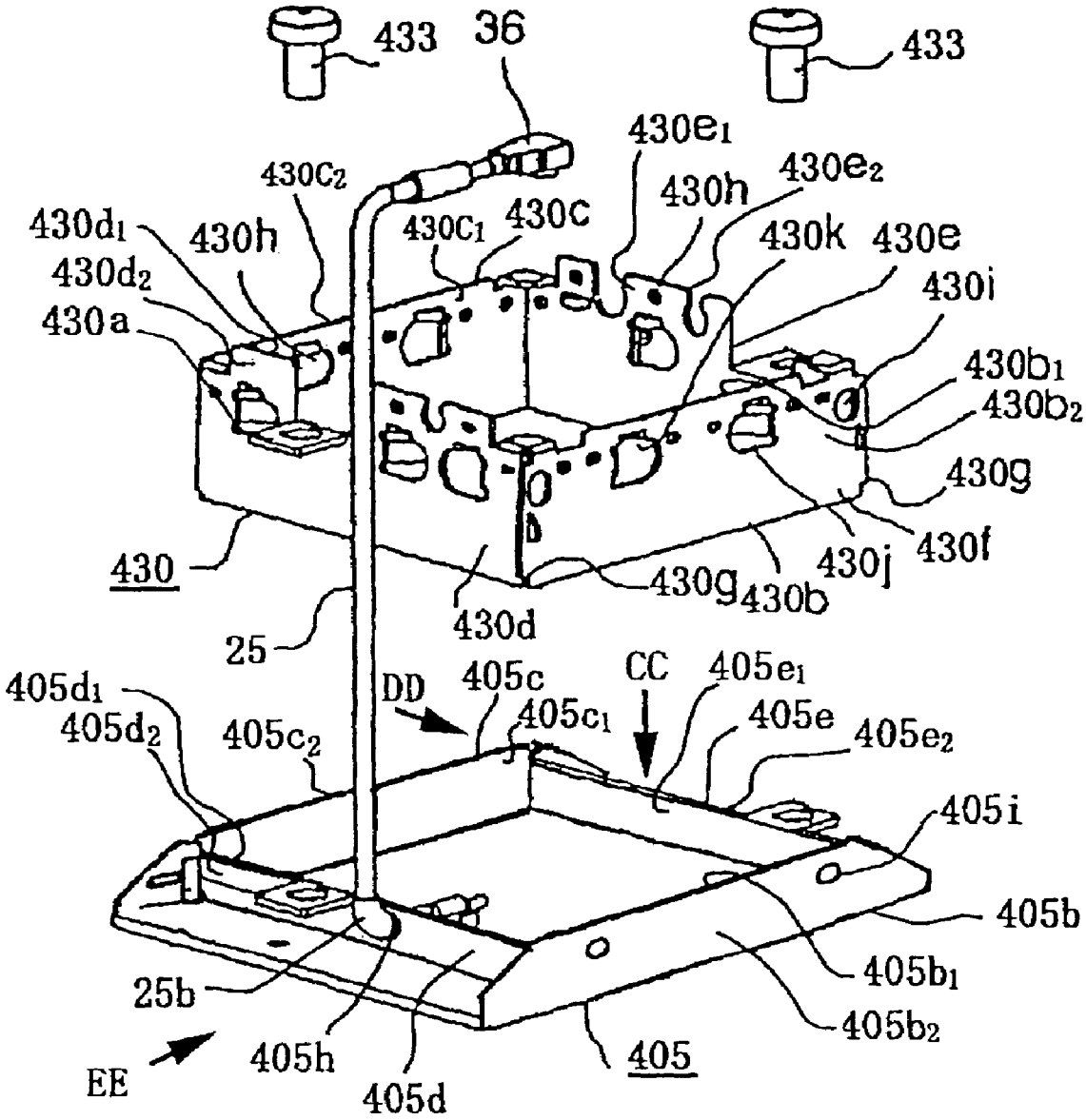
FIG. 1 is a partial enlarged perspective view of a square-shaped frame and of a base plate in an on-board antenna device for a vehicle in accordance with an embodiment of the present invention.

FIG. 1 is a partial enlarged perspective view of a square-shaped frame and a base plate of an on-board antenna device for a vehicle in accordance with an embodiment of the present invention.

Figure 20:
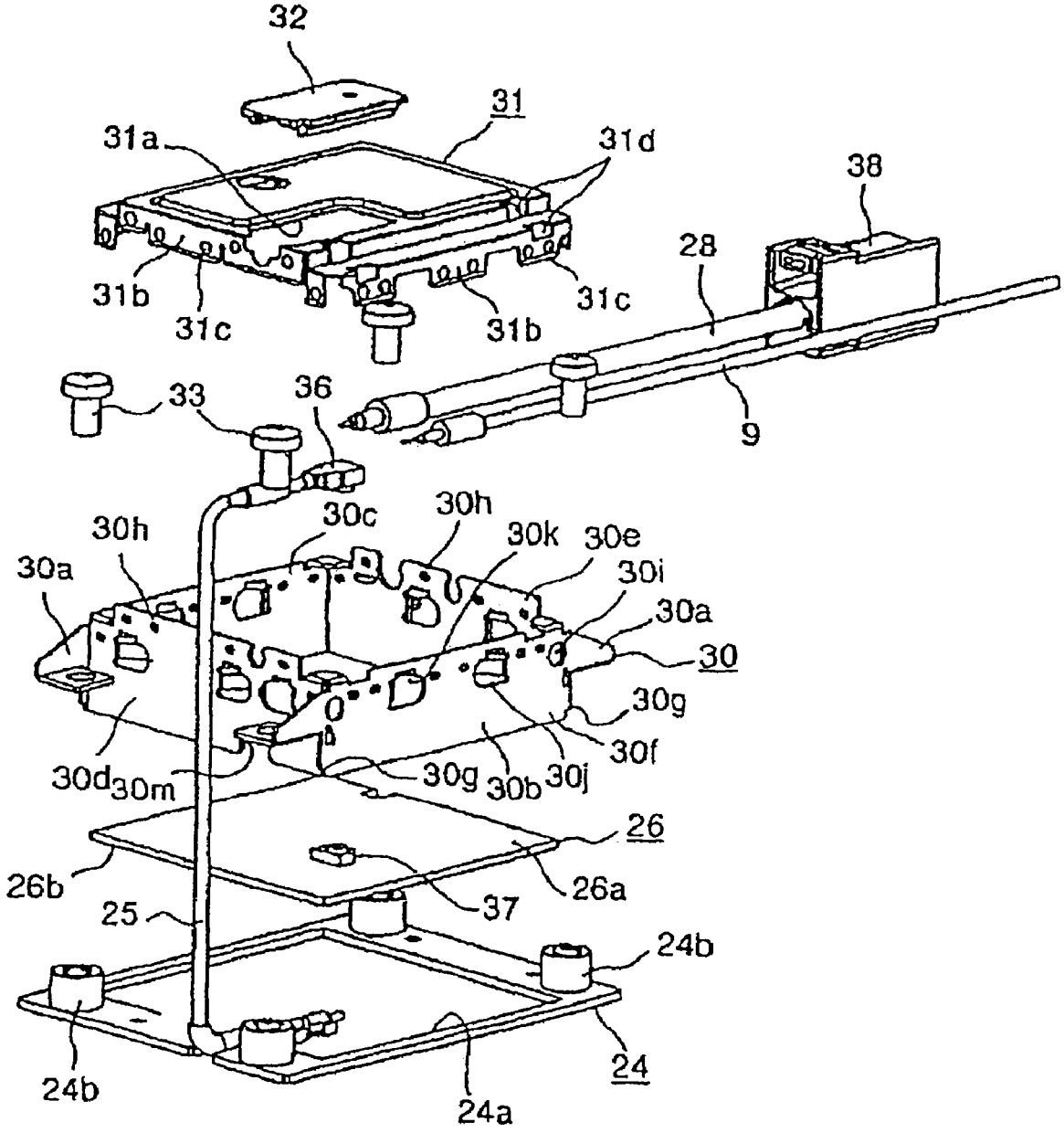
FIG. 20 PRIOR ART
FIG. 20 is an exploded perspective view of an electronic circuit unit in the prior art.

A frame 430, which is formed by metallic, of square-shape shown in FIG. 1 enables to be assembled onto the base plate 405, which is formed by metallic, in a similar manner for the conventional on-board antenna device shown in FIG. 20. However, the assembling manner is not subject matter of the present invention.

As shown in FIG. 1, an aperture 405*h* for passing a feeder cable 25 is provided in a base plate 405. One end (feeding side) of the feeder cable 25 is connected to a coplanar antenna (a radiation element 22 and a ground element 23). In that case, it is understood in those skilled in the art that the aperture 405*h* has just enough size to make a feeder cable 25 and a protection tube 25*b* thereof pass through, and that the connection of the one end (feeding side) of the feeder cable 25 is able to be assembled after passing the feeder cable 25 to the aperture 405*h*.

Moreover, the base plate 405 has feature elements of the present invention, on which metallic "walls" (hereinafter, referred to as leakage prevention walls) for preventing the leakage of radiation energy of the on-board antenna device to external thereof is provided. The leakage prevention walls are composed of a pair of leakage prevention walls 405*b* and 405*c*, which are mutually opposed, and a pair of leakage prevention walls 405*d* and 405*e*, which are mutually opposed. The each of leakage prevention walls 405*b*, 405*c*, 405*d* and 405*e* is arranged in substantially parallel to the outside of each of sidewalls 430*b*, 430*c*, 430*d* and 430*e* of the frame 430. Therefore, the inner-surface of each of the leakage prevention walls 405$b_1$, 405$c_1$, 405$d_1$ and 405$e_1$ is mutually opposed to the outer-surface of the sidewalls 430$b_2$, 430$c_2$, 430$d_2$ and 430$e_2$, respectively. In the conventional on-board antenna device (FIG. 20), the base plate 24 needs to maintain the electric connection of an engagement portion between the stopper 30*g* of the frame and the opening 24*a* of the base plate, because the change of radiation energy on the antenna performance may be caused depending on the condition of the connection. However, in accordance with the embodiment of the present invention, loss of the antenna gain of the on-board antenna device may be reduced by arranging the leakage prevention walls of the base plate 405, even if the engagement portion between the stopper 30*g* of the frame and the opening 24*a* of the base plate becomes electrically non-connection. In that case, while the arrangement of the leakage prevention walls becomes one factor that causes the important effect for the antenna performance of the on-board antenna device, a method for defining the arrangement of the leakage prevention walls is provided as described later. Moreover, FIG. 1 shows that an aperture 405*i* for pulling out water may be designed into the leakage prevention wall 405*b* according to the method for defining the arrangement of the leakage prevention walls, so that the arrangement of the aperture 405*i* corresponds to the position of the aperture 430*i* for pulling out of the water.

The construction of leakage prevention walls of a base plate in accordance with the present invention and the method for defining the arrangement of the leakage prevention walls are described as follows.

Figure 2:
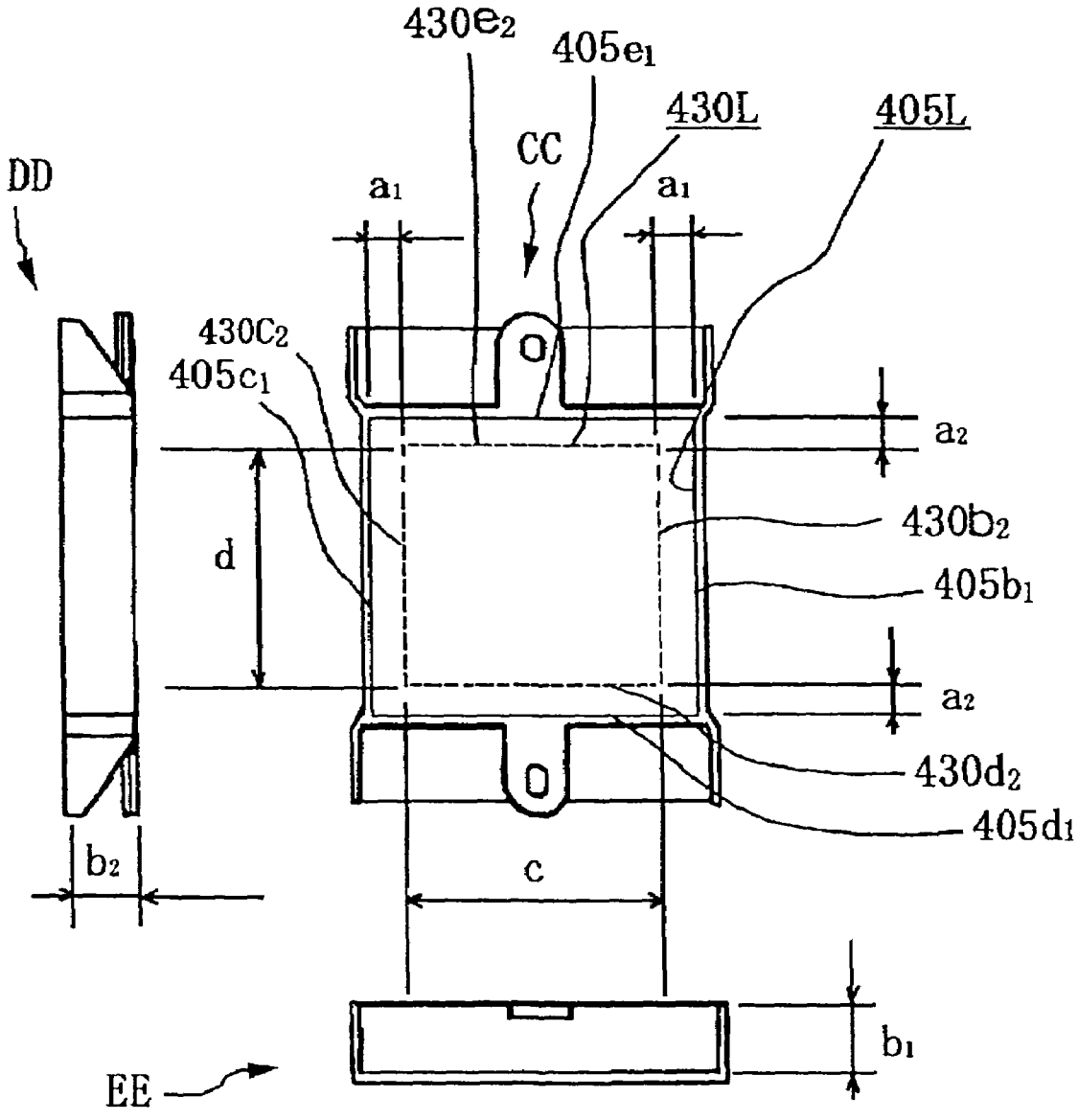
FIG. 2 is a plan view explaining the manner defined for an arrangement of leakage prevention walls in accordance with the present invention.

At first, the method for defining the arrangement of the leakage prevention walls is now described. FIG. 2 is a plan view explaining the method defined for an arrangement of leakage prevention walls in accordance with the present invention. The base plate 405 and the sidewall shape of the frame 430, which are shown in FIG. 1, are briefly shown in FIG. 2 as a plan view, and each of the inner-surface locations of the leakage prevention walls (which correspond to 405$b_1$, 405$c_1$, 405$d_1$ and 405$e_1$ shown in FIG. 1) of the base plate are shown in solid lines 405L and each of the outer-surface locations of the sidewalls (which correspond to 430$b_2$, 430$c_2$, 430$d_2$ and 430$e_2$ shown in FIG. 1) of the frame are shown in dot lines 430L. Moreover, a plan view CC and side views DD and EE shown in FIG. 2 correspond to views observed from each direction indicated by arrows CC, DD and EE shown in FIG. 1, respectively. In addition, each element size that becomes important as an arrangement relation between the base plate 24 and the square-shaped frame 30 are shown as the distances $a_1$ and $a_2$ between the frame and the leakage prevention walls, the width c of the frame, the length $b_1$ of the frame, and the heights $b_1$ and $b_2$ of the leakage prevention walls in FIG. 2. In that case, the height $b_1$ represents the height of each of the leakage prevention walls within the width c of the square-shaped frame, and similarly the height $b_2$ represents of the height of each of the leakage prevention walls within the length d of the square-shaped frame. That is, four leakage prevention walls are arranged so that each of the leakage prevention walls becomes substantially parallel to each of four sidewalls of the housing (i.e. four sidewalls of the square-shaped frame). "Distance between a frame and leakage prevention walls" means the metric of each of opposite surfaces between the outer-surface of a square-shaped frame and the inner-surface of a leakage prevention wall. Moreover, "Heights of leakage prevention walls" means the height ($b_1$ shown in FIG. 2) of leakage prevention walls of a base plate.

In FIG. 2, it is defined that the length d and the width c of the frame are shorter than a wavelength of a receiving frequency band of the on-board antenna device and that the width c and the length d are longer than ⅕ of the wavelength and that the distances $a_1$ and $a_2$ between a frame and leakage prevention walls are 0.6% or less of the wavelength. Suitably, the distances $a_1$ and $a_2$ are 0.3% or less of the wavelength.

Moreover, the heights $b_1$ and $b_2$ of the leakage prevention walls are defined by 3% or more of the wavelength in FIG. 2. Suitably, the heights $b_1$ and $b_2$ are defined by 6% or more of the wavelength.

As described with regard to FIG. 1, the aperture 405*i*, which functions as pulling out water, may be designed into the base plate 405. The maximum diameter of the aperture 405*i* needs to keep more than a predetermined size to function as pulling out water in the frame, regardless of mounting of the leakage prevention walls. On the other hand, the maximum diameter of the aperture 405*i* needs to keep less than a predetermined size to function as the antenna performance for preventing the leakage of the energy. Otherwise, the aperture 405*i* will effect in undesirable influence for the antenna performance.

Then, the method for defining the size of the aperture designed into the leakage prevention walls is described.

Figure 3A:
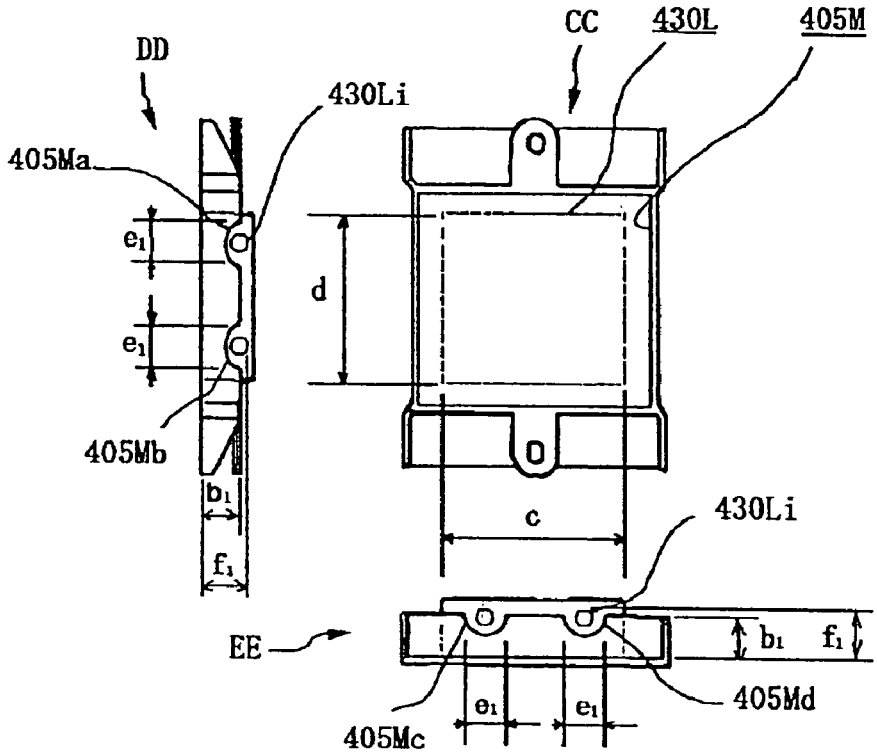
FIG. 3A is a plan view explaining the manner defined for an arrangement of leakage prevention walls and at least one aperture designed in these walls in which the heights of the leakage prevention walls are low in accordance with the present invention.
Figure 3B:
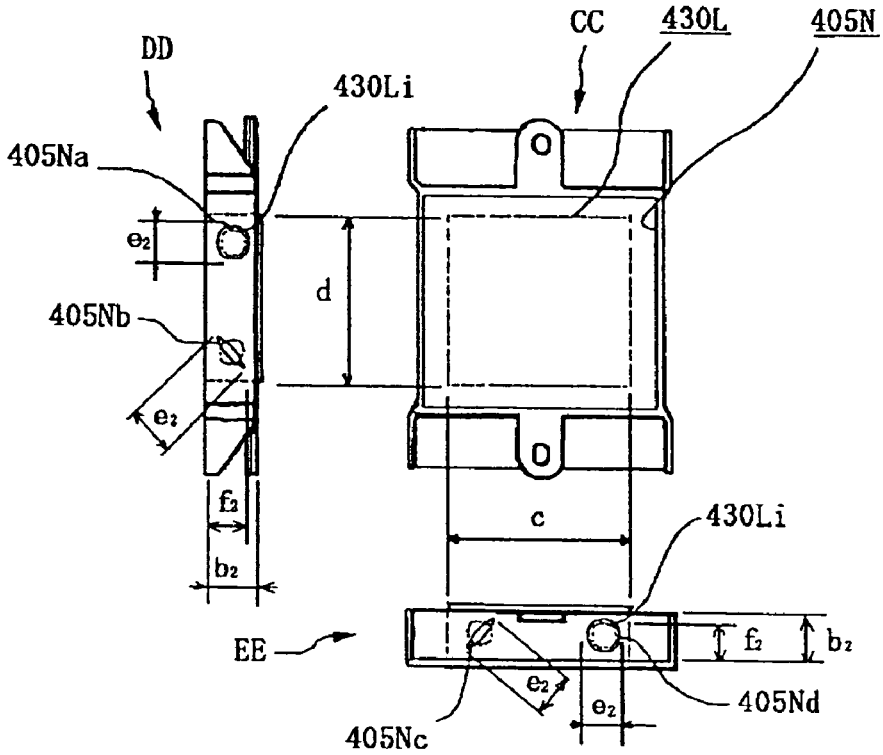
FIG. 3B is a plan view explaining the manner defined for an arrangement of leakage prevention walls and at least one aperture designed in these walls in which the heights of the leakage prevention walls are high in accordance with the present invention.

FIG. 3A is a plan view explaining the manner defined for an arrangement of leakage prevention walls and at least one aperture designed into these walls in which the heights of the leakage prevention walls are "low" in accordance with the present invention. FIG. 3B is a plan view explaining the manner defined for an arrangement of leakage prevention walls and at least one aperture designed into these walls in which the heights of the leakage prevention walls are "high" in accordance with the present invention. In FIGS. 3A and 3B, the wall-shapes of the frame 430 and of the base plate 405 are schematically shown, in case of the different heights ($b_1$ and $b_2$) of the leakage prevention walls with respect to the sidewalls of the frame, respectively. In FIGS. 2, 3A and 3B, the same numerals are fixed to similar components or elements. Moreover, the inside portions of the leakage prevention walls of the base plate are indicated by a fixed lines 405M (as shown in FIG. 3A) and 405N (as shown in FIG. 3B), and these inside portions may be considered to as similar elements for the inside portions 405L (as shown in FIG. 2) of the leakage prevention walls of the base plate. That is, the inside portions 405M and 405N correspond to 405*$b_1$*, 405*$c_1$*, 405*$d_1$* and 405*$e_1$* which are shown in FIGS. 1 and 2. The inside portions 430L also correspond to 430*$b_2$*, 430*$c_2$*, 430*$d_2$* and 430*$e_2$* which are shown in FIGS. 1 and 2. Moreover, a plan view CC and a side views DD and EE, which are shown in FIGS. 3A and 3B, correspond to views observed from each direction indicated by arrows CC, DD and EE shows in FIG. 1, respectively. As for the aperture 430Li designed into the sidewalls of the frame, which is shown in FIGS. 3A and 3B, correspond to 430*i* shown in FIG. 1. In that case, the term "low" ($b_1$ shown in FIG. 3A) and the term "high" ($b_2$ shown in FIG. 3B) with respect to the heights of the leakage prevention walls mean to be referred to in the relation of the aperture 430Li of the frame.

Since the height $b_1$ of the leakage prevention wall is "low" in FIG. 3A, the aperture 405Ma designed into the leakage prevention wall of the base plate 405M has a "recess-shaped" aperture according to the aperture 430Li of the frame. Since apertures 405Ma, 405Mb, 405Mc and 405Md have same function and are defined in a similar manner, the aperture 405Ma is typically described. The reason why the aperture 405Ma and the aperture 430Li are correspondingly arranged is for the purpose of that the water in the frame may be efficiently pulled out from the aperture 405Ma. While the shape of the aperture 405Ma shown in FIG. 3A is represented as substantial elliptical-shape, the shape of such aperture may be circular-shape, oval-shape, polygonal-shape or other. The size of such aperture may be defined by maximum length (for example, the diameter in case of circular-shape, the major axis in case of elliptical-shape, and the maximum axis in case of polygonal-shape). Hereinafter, the maximum length of the size of such aperture referred to as "the maximum length of an aperture". The maximum length of the aperture 405Ma shown in FIG. 3A is represented as "$e_1$". In that case, the size or the arrangement between the aperture 405Ma and the aperture 430Li is no need to be precise metric, if the function of the aperture 405Ma is fulfilled by adjusting the distance between the square-shaped frame and the base plate, even if neither the aperture 405Ma nor the aperture 430Li are correspondingly arranged. That is, the size or the arrangement of apertures needs not specify, and the apertures have to fulfill only the function for pulling out water in relevant arrangement, as to the shape and the height $f_1$ of the aperture 430Li of the frame, as well as the shape and the height $b_1$ of the aperture 405Ma of the base plate.

Since the height $b_2$ of the leakage prevention wall is "high" in FIG. 3B, the aperture 405Na designed into the leakage prevention wall of the base plate 405N has a "circular-shaped" aperture according to the aperture 430Li of the frame. Since apertures 405Na, 405Nb, 405Nc and 405Nd have same function and are defined in a similar manner, the aperture 405Na is typically described. The reason why the aperture 405Na and the aperture 430Li are correspondingly arranged is for the purpose of that the water in the frame may be efficiently pulled out from the aperture 405Na. The maximum length of the aperture 405Na shown in FIG. 3B is represented as "$e_2$". In that case, the size or the arrangement between the aperture 405Na and the aperture 430Li are no need to be precise metric, if the function of the aperture 405Na is fulfilled by adjusting the distance between the square-shaped frame and the base plate, even if neither the aperture 405Na nor the aperture 430Li are correspondingly arranged. That is, the size or the arrangement need not specify, and the aperture has to fulfill only the function for pulling out water in relevant arrangement, as to the shape and the height $f_2$ of the aperture 430Li of the frame, as well as the shape and the height $b_2$ of the aperture 405Na of the base plate. In addition, it is possible to use the modification thereof, such as gradient "elliptical-shaped" apertures represented as 405Nb and 405Nc, and the maximum length of each of the apertures 405Nb and 405Nc is represented as "$e_2$" for the convenience of the description.

In accordance with the method for defining the arrangement of the leakage prevention walls according to the present invention, the maximum length of the aperture is ¼ or less of a wavelength of a receiving frequency band of the on-board antenna device, and the area of the aperture is larger than the area of the circle of 2 mm in the diameter, and is 1.5% or less of the square-value of the wavelength.

Then, the grounds for defining the arrangement of the leakage prevention walls of the base plate and for defining the size of the aperture in accordance with the present invention are described as follows.

At first, the reason why the distances $a_1$ and $a_2$ between the leakage prevention walls and the square-shaped frame are 0.6% or less of the wavelength is now described.

Figure 4:
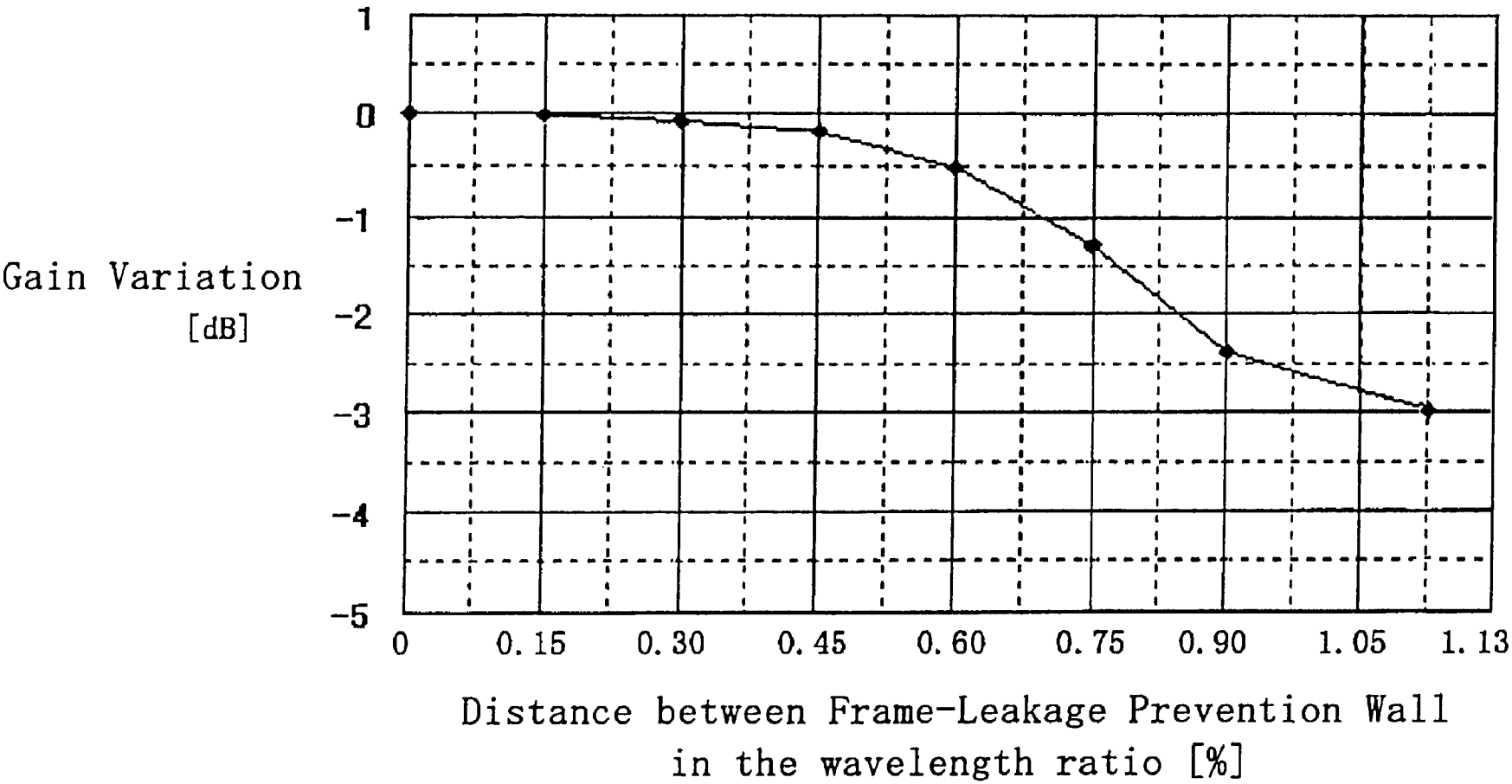
FIG. 4 is a characteristic chart showing the antenna gain variation based on the distance between leakage prevention walls and a square-shaped frame.

FIG. 4 is a characteristic chart showing the antenna gain variation based on the distance between leakage prevention walls and a square-shaped frame. In FIG. 4, the variation of the antenna gain is shown in which the distances $a_1$ and $a_2$ between the frame and the leakage prevention walls are changed from 0 to 1.1% in the wavelength ratio, where the heights $b_1$ and $b_2$ of the leakage prevention walls are sufficiently high. The variation of the antenna gain is a relative variation of the average gain value in the elevation-angle 20 deg section of Left Handed Circularly polarized (LHC) wave and is normalized as 0 dB at the distance $a_1$ and $a_2$ as 0.16% of the wavelength ratio. As shown in FIG. 4, the longer distance $a_1$ and $a_2$ between the leakage prevention walls and the square-shaped frame may reduce the antenna gain more. As the variation of the antenna gain is generally acceptable for 1 dB, the distances $a_1$ and $a_2$ should be at least 0.7% or less of the wavelength. Thereby, it is preferable that the distances $a_1$ and $a_2$ are 0.6% or less of the wavelength to fulfill the requirement of the antenna performance.

Moreover, it is understood that the shorter distance $a_1$ and $a_2$ make the antenna performance better in FIG. 4. In addition, it is preferable that the distances $a_1$ and $a_2$ are 0.3% or less of the wavelength so as to be within measurement tolerance as the variation of substantial 0 dB. Therefore, the distances $a_1$ and $a_2$ may be more suitably defined by 0.6% or less of the wavelength in accordance with the present invention. It is understood to be able to intercept the leakage of the radiation energy from the inside of the antenna module to outside thereof, and to be able to obtain the stable antenna performance with the method for defining the arrangement of the leakage prevention walls.

Then, the reason why the heights $b_1$ and $b_2$ of the leakage prevention walls are 3% or more of the wavelength is described.

Figure 5:
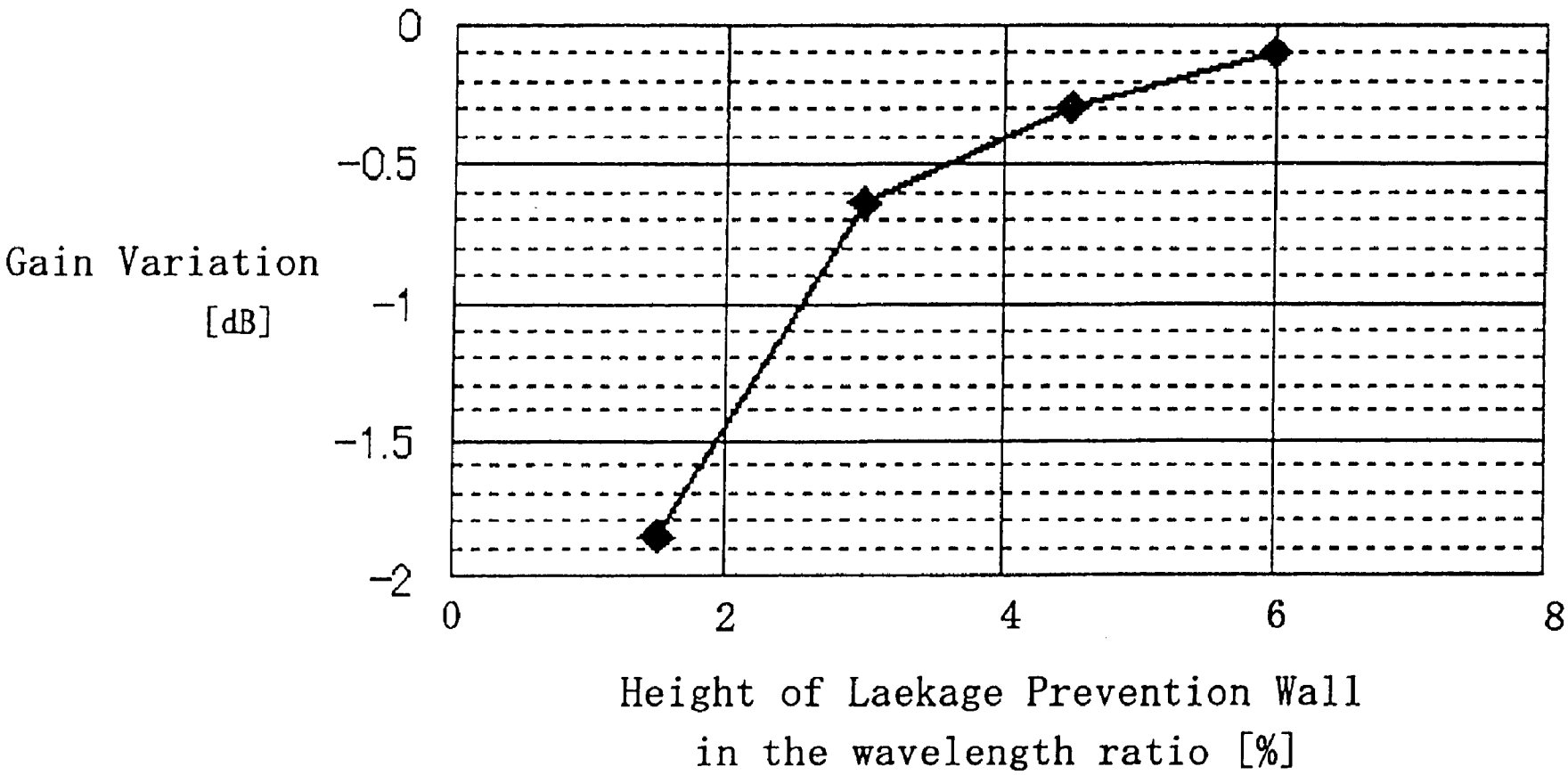
FIG. 5 is a characteristic chart showing the antenna gain variation based on the heights of leakage prevention walls.

FIG. 5 is a characteristic chart showing the antenna gain variation based on the heights of leakage prevention walls. In FIG. 5, the variation of the antenna gain is shown in which the heights $b_1$ and $b_2$ of the leakage prevention walls are changed from 1.5 to 6% in the wavelength ratio, where the distances $a_1$ and $a_2$ between the frame and the leakage prevention walls are 0.15% of the wavelength. The variation of the antenna gain is a relative variation of the average gain value in the elevation-angle 20 deg section of Left Handed Circularly polarized (LHC) wave and is normalized as 0 dB at the infinite of the height of the leakage prevention wall. As shown in FIG. 5, the lower the heights $b_1$ and $b_2$ reduce antenna gain more. As the variation of the antenna gain is generally acceptable for 1 dB, the heights $b_1$ and $b_2$ should be at least 2.5% or more of the wavelength. Thereby, it is preferable that the heights $b_1$ and $b_2$ are 3% or more of the wavelength to fulfill the requirement of the antenna performance.

Moreover, it is understood that the higher heights $b_1$ and $b_2$ make the antenna performance better in FIG. 5. In addition, it is preferable that the heights $b_1$ and $b_2$ are suitably 6% or more of the wavelength so as to be within measurement tolerance as the variation of substantial 0 dB. Therefore, the distances $b_1$ and $b_2$ may be more suitably defined by 3% or more of the wavelength in accordance with the present invention. It is understood to be able to intercept the leakage of the radiation energy from the inside of the antenna module to outside thereof, and to be able to obtain the stable antenna performance with the method for defining the arrangement of the leakage prevention walls.

Figure 6A:
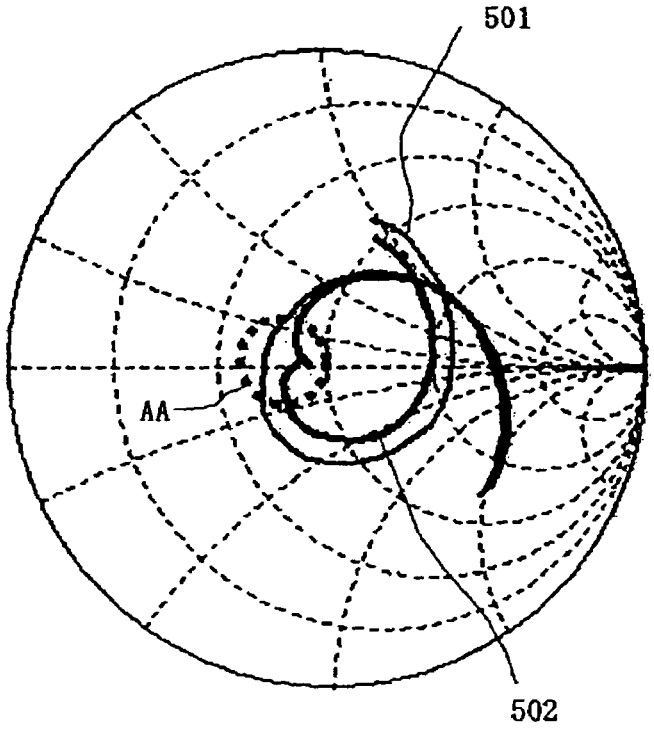
FIG. 6A is an impedance characteristic chart showing electrically contacted condition and electrically non-contacted condition in connection between a housing and a base plate in a conventional on-board antenna device.
Figure 6B:
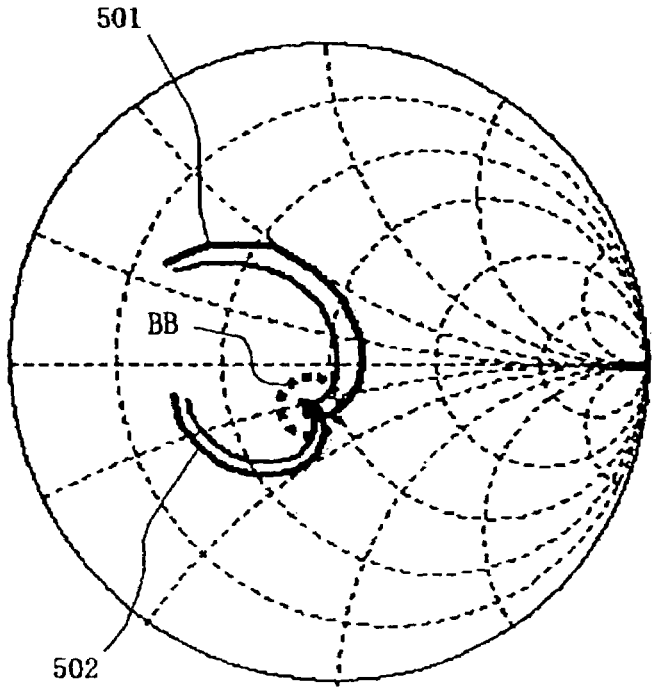
FIG. 6B is an impedance characteristic chart showing electrically contacted condition and electrically non-contacted condition in connection between a housing and a base plate in accordance with an embodiment of the present invention.

In FIGS. 6A and 6B, the measurement results in Smith chart are shown for comparing the impedance characteristics of an on-board antenna device in accordance with one embodiment of the present invention with that of a conventional on-board antenna device. FIG. 6A is a Smith chart comparing the impedance characteristics of electrically contacted condition (shown as 502) with that of electrically non-contacted condition (shown as 501) with respect to a connection between a housing and a base plate in the conventional on-board antenna device. FIG. 6B is a Smith chart comparing the impedance characteristics of electrically contacted condition (shown as 502) with that of electrically non-contacted condition (shown as 501) with respect to a connection between a housing and a base plate in an on-board antenna device in accordance with an embodiment of the present invention. In that case, "on electric contact with respect to a connection between a housing and a base plate" means on the state of electrically high impedance in contact between the base plate and the frame, and "on electric non-contact with respect to a connection between a housing and a base plate" means on the state of electrically normal contact in contact of all connections between the base plate and the frame. In FIG. 6A, it is understood that the variation of the antenna performance may be caused by changing the state in contact between the frame (i.e. a part of a housing) and the base plate, because "Hollow" of the impedance characteristics, which is one factor of the circularly-polarized resonance, has disappeared in the electrically non-contacted condition (which is indicated as AA). On the other hand, in FIG. 6B, it is understood that the "Hollow" (which is indicated as BB) of the circularly-polarized resonance is represented without influencing the state in contact between the frame and the base plate.

Therefore, it was verified that the on-board antenna device in accordance with the present invention may stabilize the antenna performance without depending on the condition of the connection between the frame and the base plate, and it was confirmed to be able to obtain more high quality or more high stability for an on-board antenna device in accordance with the present invention.

Then, the reason why the maximum length $e_1$ and $e_2$ of the aperture is ¼ or less of a wavelength of a receiving frequency band of the on-board antenna device is described, and the reason why the area of the aperture is larger than the area of the circle of 2 mm in the diameter and is 1.5% or less of the square-value of the wavelength so that water in the frame is efficiently pulled out from the aperture 405Na is further described.

The aperture 30*i* for pulling out water is designed in the lower side of the electronic circuit unit 21 of the on-board antenna device, because the on-board antenna device is formed on the surface of the rear glass which is slantingly arranged to the ground. That is, the component mounting surface 26*a* and the reflecting surface 26*b* of the circuit board 26 might not be filled with water due to the aperture 30*i* of the electronic circuit unit 21 even if the water comes in the on-board antenna device. This is disclosed in the Japanese Patent Application Laid-Open No. 2006-13957. Moreover, it is known that the area of the aperture 30*i* needs to be larger than the area of the circle of 2 mm in the diameter as the commercial experience value for suitably pulling out water. In addition, any problem was not caused in the function of the aperture for pulling out water in the conventional on-board antenna device, since there were not the leakage prevention walls. However, the leakage prevention walls are provided for the base plate of the on-board antenna device in accordance with the present invention. To prevent the loss of the antenna performance, the size of the aperture of the leakage prevention wall should be newly defined to keep the function for pulling out water.

Figure 7:
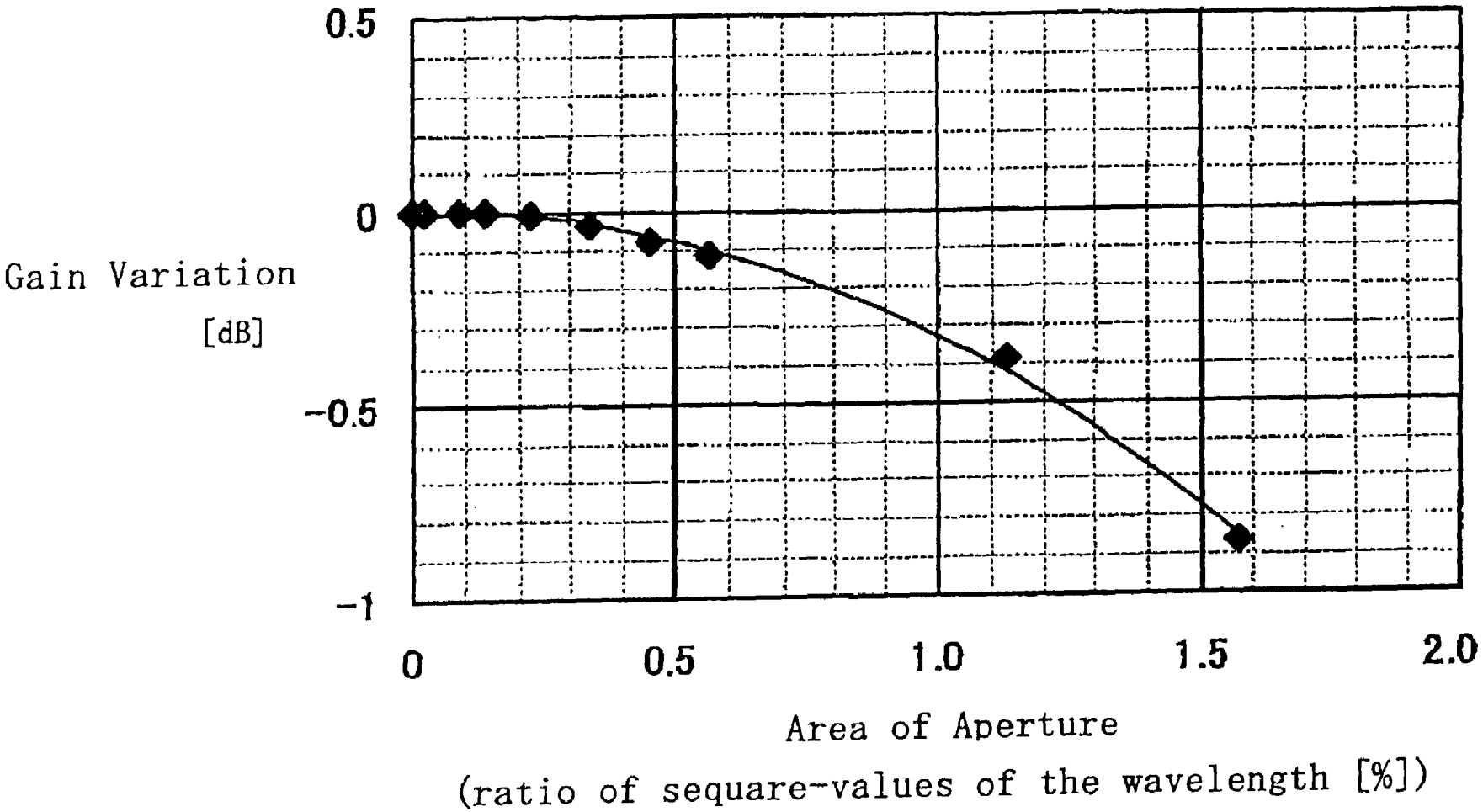
FIG. 7 is a characteristic chart showing the antenna gain variation with respect to the area of an aperture of a leakage prevention wall, in which a leakage prevention wall has an aperture.

FIG. 7 is a characteristic chart showing the antenna gain variation with respect to the area of an aperture of a leakage prevention wall, in which a leakage prevention wall has an aperture. In FIG. 7, the variation of the antenna gain in which the area of the aperture is varied from 0 to 1.6% in the ratio to the square-value of the wavelength is shown. In that case, variation of the antenna gain is a relative variation of the average gain value in the elevation-angle 20 deg section of Left Handed Circularly polarized (LHC) wave and is normalized as 0 dB at zero of the area of the aperture. As shown in FIG. 7, the larger area of the aperture may reduce the antenna gain more. As the variation of the antenna gain is generally acceptable for 1 dB, the area of the aperture should be at least 1.5% or less of the square-value of the wavelength so as to fulfill the requirement of the antenna performance. If the shape of the aperture is slit-shape and the length of the slit-shape is about ½ of the wavelength, the leakage of the radiation energy may be caused by the resonation even if the area of the aperture is small. Therefore, the maximum length of the aperture is defined as the ¼ or less of a wavelength of a receiving frequency band of the on-board antenna device so as to fulfill the requirement of the antenna performance. Therefore, if the aperture is designed into the leakage prevention walls, the maximum length of the aperture is ¼ or less of a wavelength of a receiving frequency band of the on-board antenna device, and the leakage prevention walls is defined so that the area of the aperture is larger than the area of the circle of 2 mm in the diameter and is 1.5% or less of the square-value of the wavelength.

Therefore, if an on-board antenna device comprises the base plate structure described by the first embodiment of the present invention, the variation of the antenna performance may be reduced, even on electrically non-contact condition in the contact between the stopper 30*g* of the frame and the aperture 24*a* of the base plate. Thereby, a stabilized antenna module may be provided with more high quality. Moreover, if the aperture of the leakage prevention walls is designed therein according to the method for defining the leakage prevention walls, the aperture designed therein may suitably function for pulling out undesired water to outside of an on-board antenna device even if the leakage prevention walls are provided for the on-board antenna device, like the conventional on-board antenna device.

Moreover, having such functions and advantageous effect may improve the manufacturing efficiency of the on-board antenna device. Moreover, the cost performance of antenna device is improved based on the mass production efficiency.

Then, a second embodiment, in which elements of the present invention are applied to an indirect-feeding type of an on-board antenna device, is described.

A Second Embodiment

Figure 18:
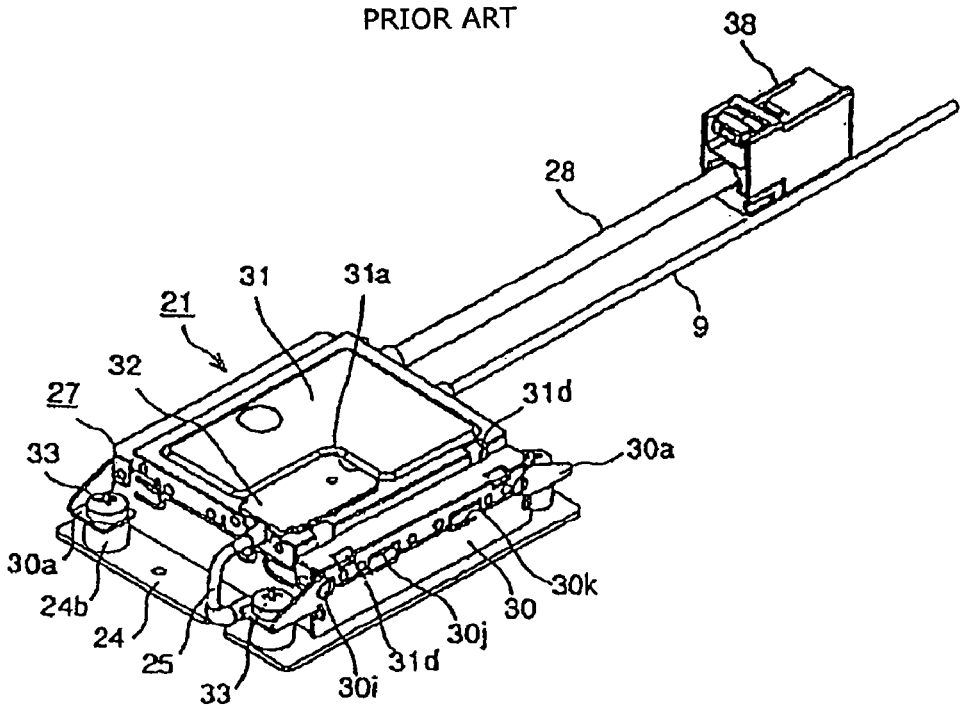
FIG. 18 PRIOR ART
FIG. 18 is a perspective view showing an electronic circuit unit of an on-board antenna device for a satellite in the prior art.
Figure 19:
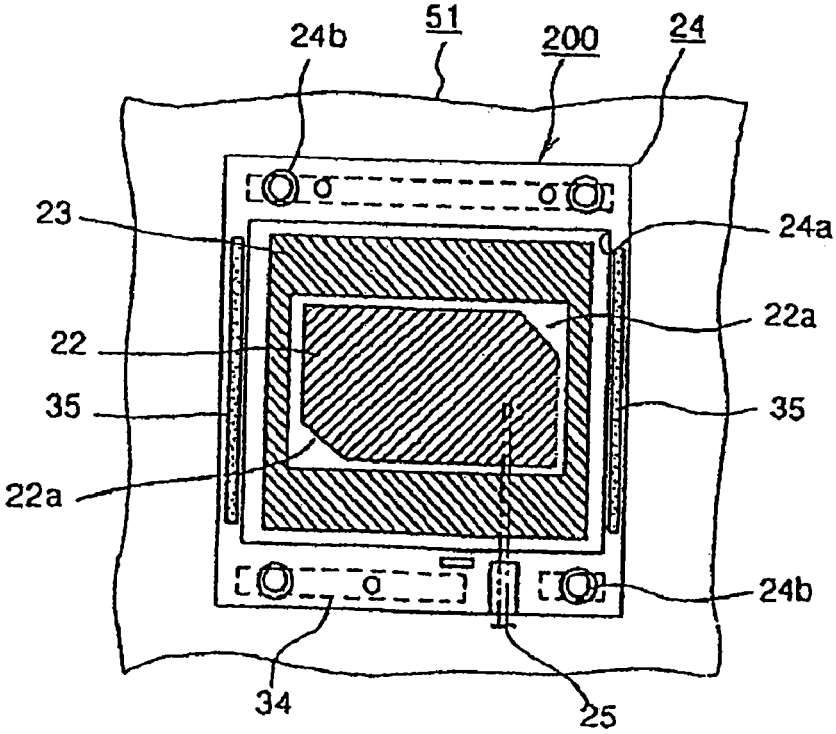
FIG. 19 PRIOR ART
FIG. 19 is a plan view showing location of a base plate and a radiation element in an electronic circuit unit of the prior art.

An indirect-feeding type of an on-board antenna device differs from the conventional on-board antenna device for a vehicle (FIGS. 18-20), and the on-board antenna device does not need to comprise the feeder cable (shown as the feeder cable 25 in FIG. 20). Hereinafter, the conventional on-board antenna device is referred to as a direct-feeding type of an on-board antenna device, and is distinguished from the indirect-feeding type.

In the second embodiment, the indirect-feeding type of the on-board antenna device is also defined by the method for defining leakage prevention walls.

The width c and the length d of a frame are shorter than a wavelength of a receiving frequency band of the on-board antenna device and are longer than ⅕ of the wavelength, and the distances $a_1$ and $a_2$ between a frame and leakage prevention walls are 0.6% or less of the wavelength (as shown in FIG. 2). Suitably, the distances $a_1$ and $a_2$ are 0.3% or less of wavelength.

Moreover, the heights $b_1$ and $b_2$ of the leakage prevention walls are defined by 3% or more of the wavelength (as shown in FIG. 2). Suitably, the heights $b_1$ and $b_2$ are defined by 6% or more of the wavelength.

The maximum length of each aperture designed into the leakage prevention walls is ¼ or less of a wavelength of a receiving frequency band of the on-board antenna device, and the area of the aperture is larger than the area of the circle of 2 mm in the diameter, and is 1.5% or less of the square-value of the wavelength (as shown in FIG. 3).

Figure 8:
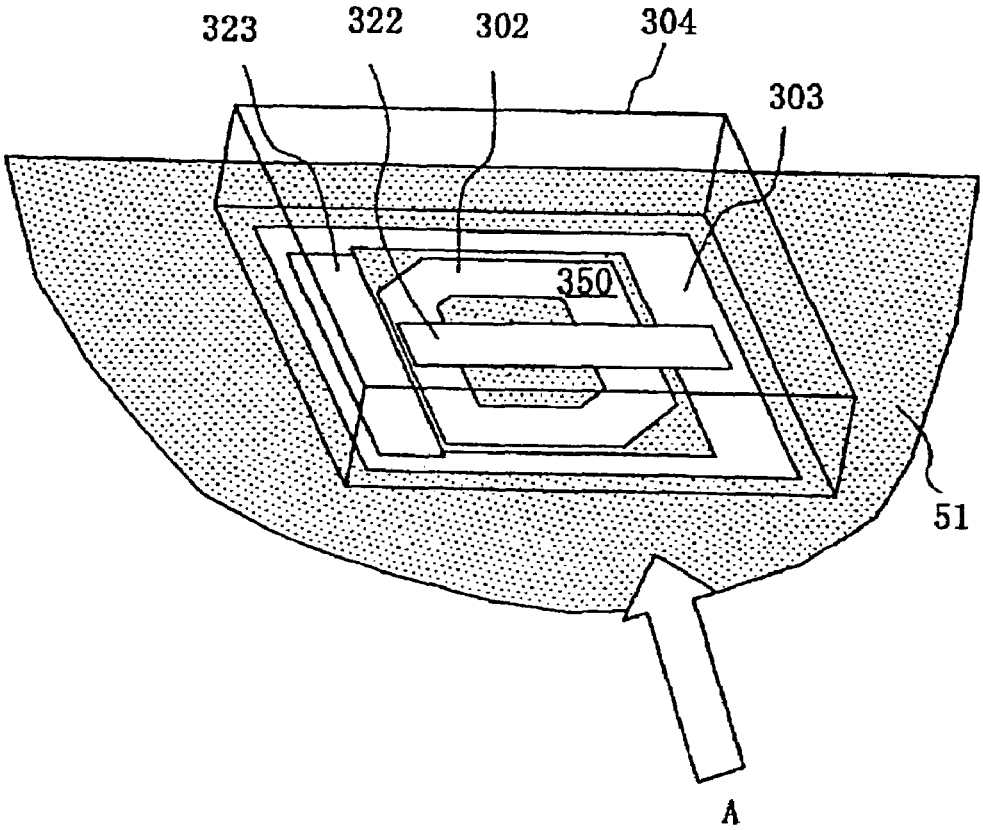
FIG. 8 is a perspective view showing the basic configuration of a feeding structure in an indirect-feeding type of an on-board antenna device for a vehicle.
Figure 9:
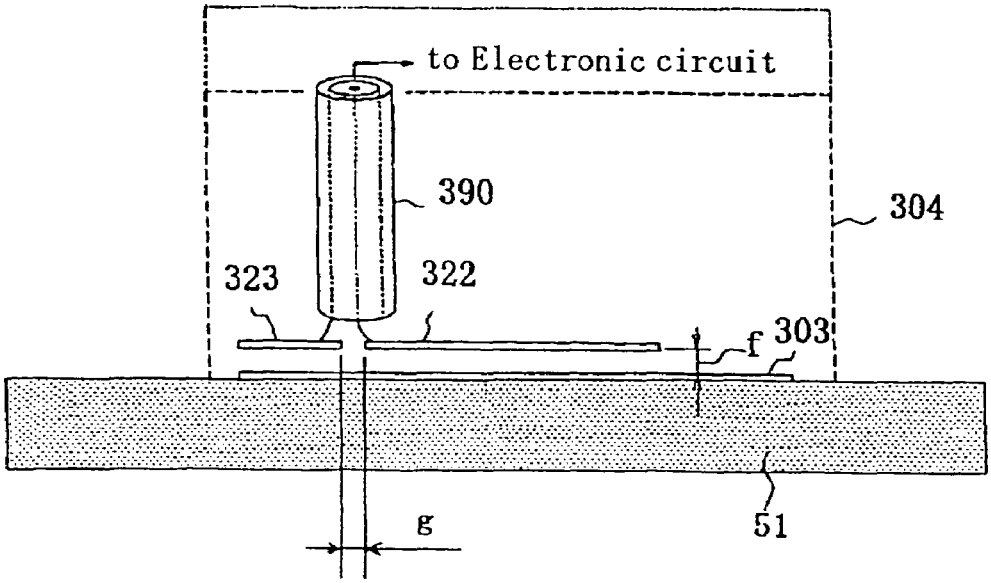
FIG. 9 is a side view of an indirect-feeding type of an on-board antenna device observed from the direction indicated by an arrow A.

FIG. 8 is a perspective view showing the basic configuration of a feeding structure in an indirect-feeding type of an on-board antenna device for a vehicle. FIG. 9 is a side view of an indirect-feeding type of an on-board antenna device observed from the direction indicated by an arrow A. In FIG. 8, a coplanar antenna 350 may be sprayed or attached on the surface of a window glass 51. An electronic circuit unit 304, which has a cavity structure, is assembled to surround the coplanar antenna 350, and only the outline of a housing of the electronic circuit unit is shown in FIG. 8 to be facilitate to understand. The electronic circuit unit 304 comprises: a box-shaped housing including an opening in the side opposed to the coplanar antenna 350; a circuit board (not shown) including pre-amplifier, the circuit board being contained in the housing; a feeding board (not shown) having feeding patterns 322 and 323; a feeder cable 390; and a base plate (not shown).

Two feeding patterns 322 and 323 are integrally formed on the feeding board 307 in the side opposed to the coplanar antenna 350. Each of these feeding patterns is composed of a square-shaped electrode formed by conductive materials.

In an example of FIGS. 8 and 9, the feeding pattern 322 is partially opposed (overlapped) to a radiation element 302 and a ground element 303, and the feeding pattern 323 is partially opposed to the ground element 303, by which the radiation element 302 and the ground element 303 are capacitive-coupled thereto (indirect-feeding). The distance (minute space) between the feeding patterns 322 and 323 and the coplanar antenna 350 is set to a predetermined value f as shown in FIG. 9, in the condition of the electronic circuit unit 304 formed on the window glass 51. The feeding patterns 322 and 323 are vertically arranged through a predetermined gap g in each other. Each of the feeding patterns 322 and 323 may be connected to an amplifier (not shown) through the feeder cable 390. In that case, the manner of connecting the feeding patterns to an electronic circuit board including the amplifier using the coaxial cable for the feeder cable 390 is shown in FIG. 9. Instead of the coaxial cable, a parallel-coupled lines or a micro-strip line may be used for the feeder cable.

As shown in FIGS. 8 and 9, the radiation element 302 and the ground element 303, which constitute the coplanar antenna, may be capacitive-coupled through the feeding patterns 322 and 323, and may be indirect-feed without using any cable for direct-feeding.

Figure 10:
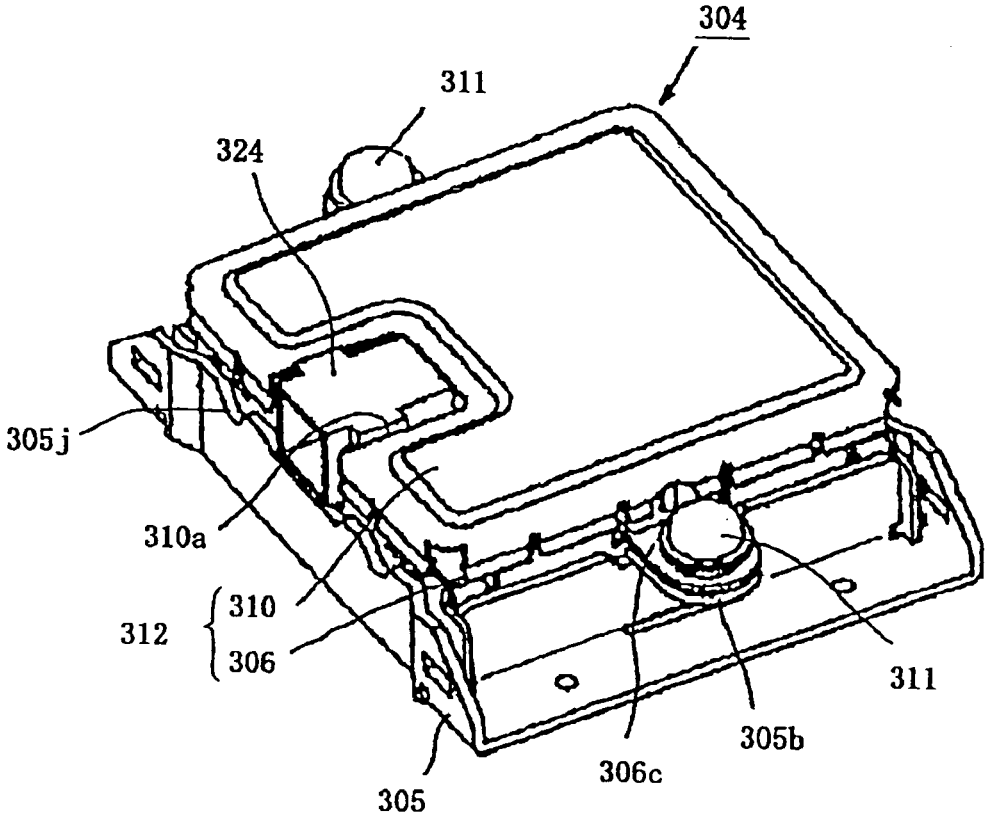
FIG. 10 is a perspective view showing an electronic circuit unit provided for an on-board antenna device in accordance with one embodiment of the present invention.
Figure 11:
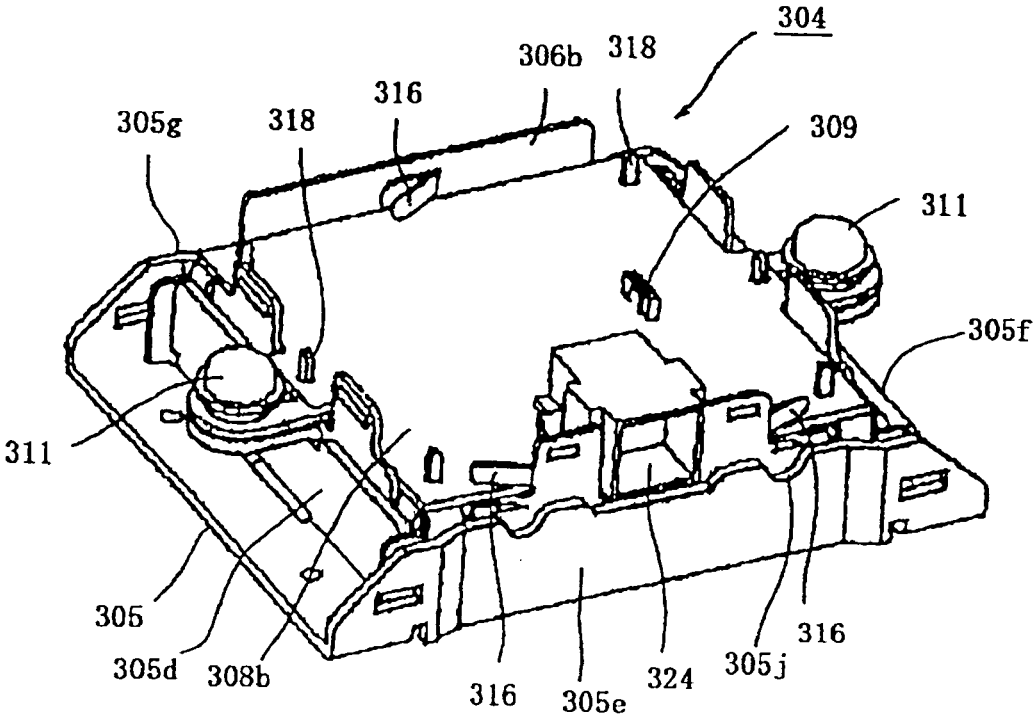
FIG. 11 is a perspective view showing the condition removed a cover of an electronic circuit unit provided for an on-board antenna device in accordance with one embodiment of the present invention.
Figure 12:
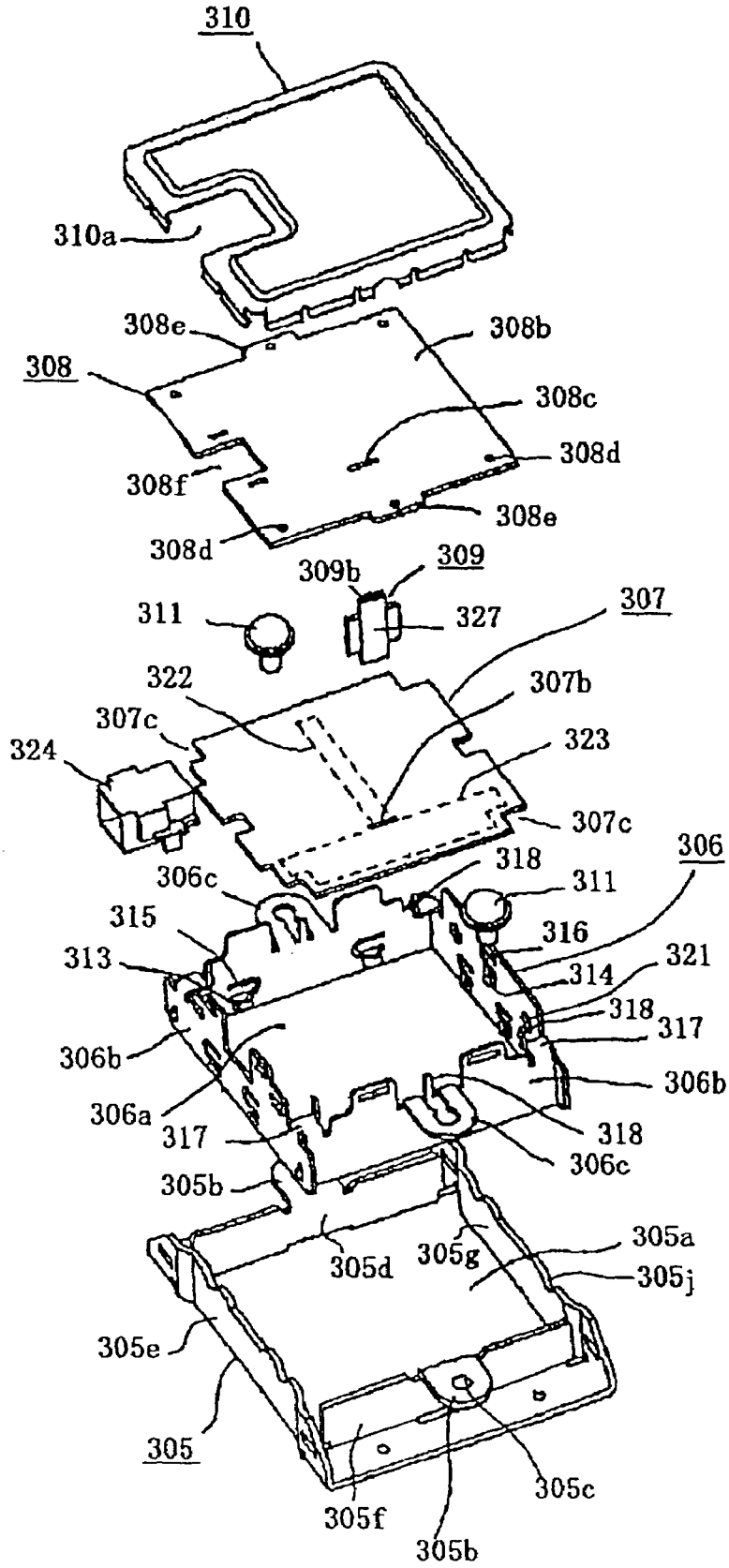
FIG. 12 is an exploded perspective view of an electronic circuit unit in accordance with one embodiment of the present invention.
Figure 13:
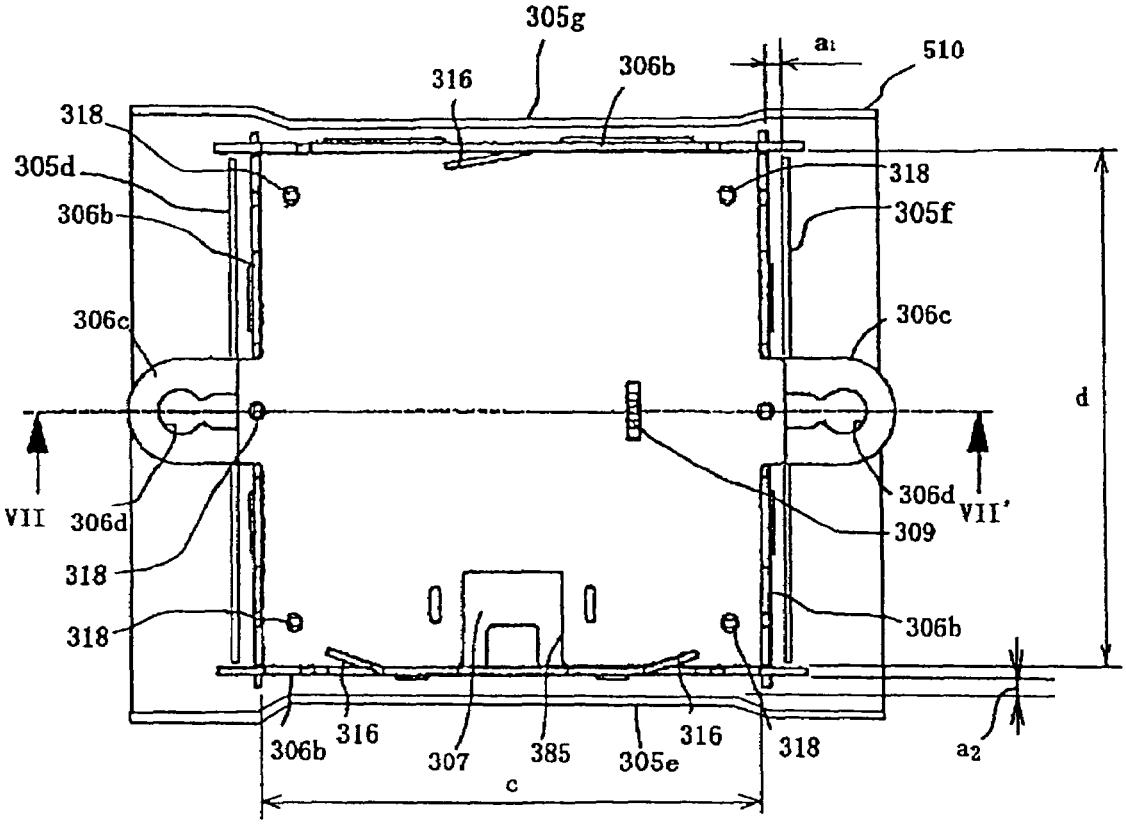
FIG. 13 is a plan view showing an electronic circuit unit omitted a part thereof in accordance with one embodiment of the present invention.
Figure 14:
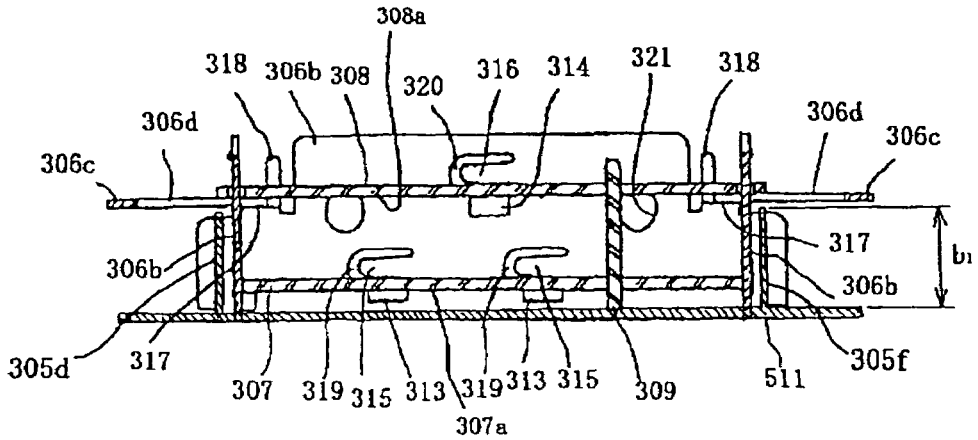
FIG. 14 is a cross-sectional view of the electronic circuit unit along the line VII-VII' in accordance with one embodiment of the present invention.
Figure 15:
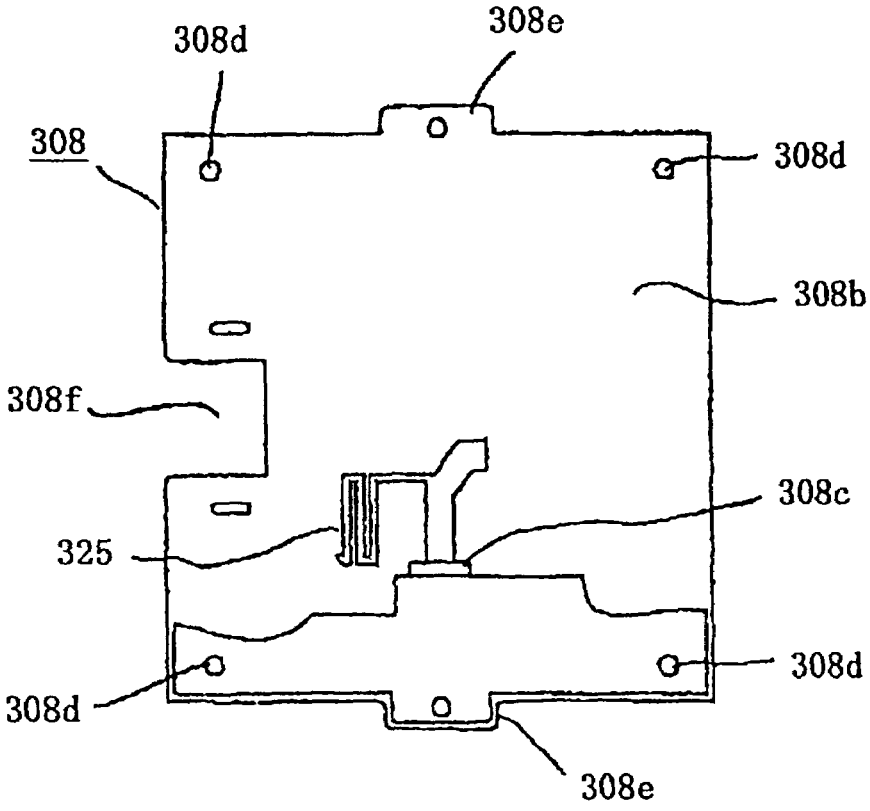
FIG. 15 is a plan view of a circuit board in accordance with one embodiment of the present invention.
Figure 16:
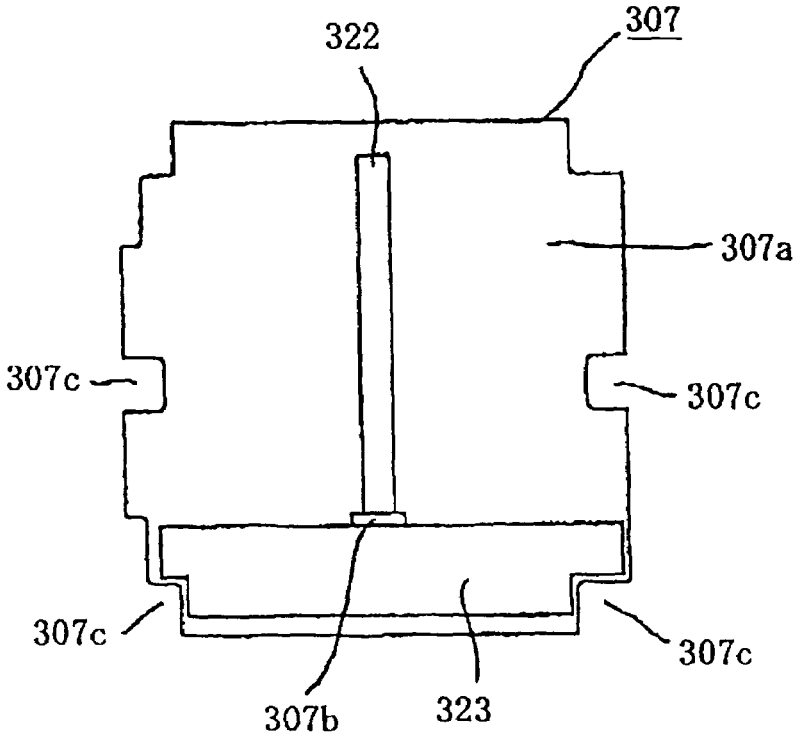
FIG. 16 is a plan view of a feeding board in accordance with one embodiment of the present invention.
Figure 17A:
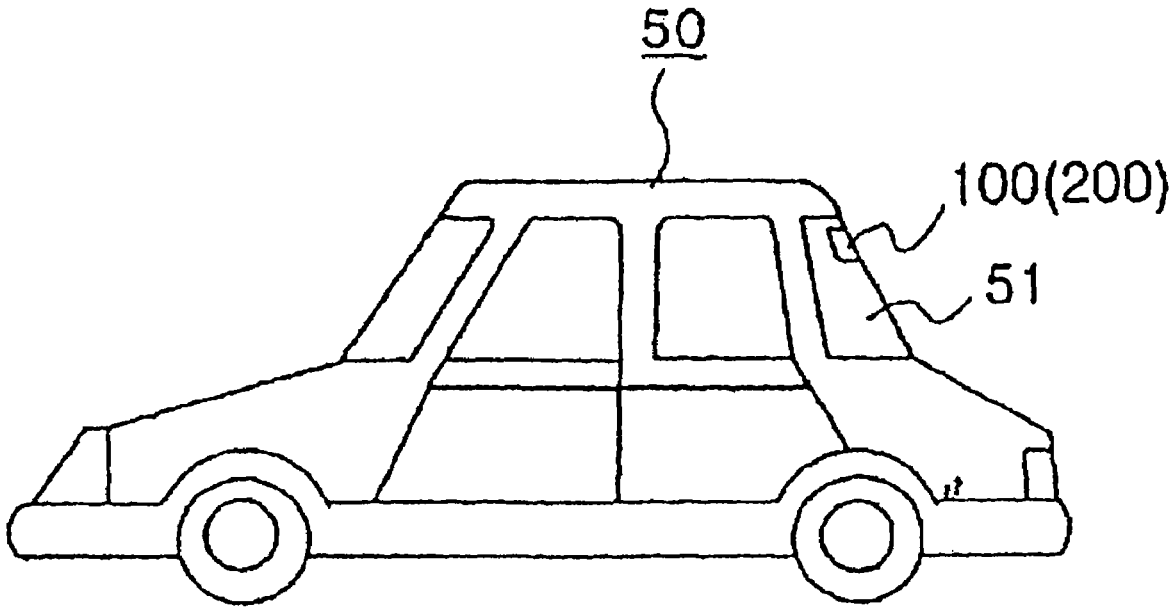
FIG. 17A PRIOR ART
FIG. 17A is a side view of a vehicle.
Figure 17B:
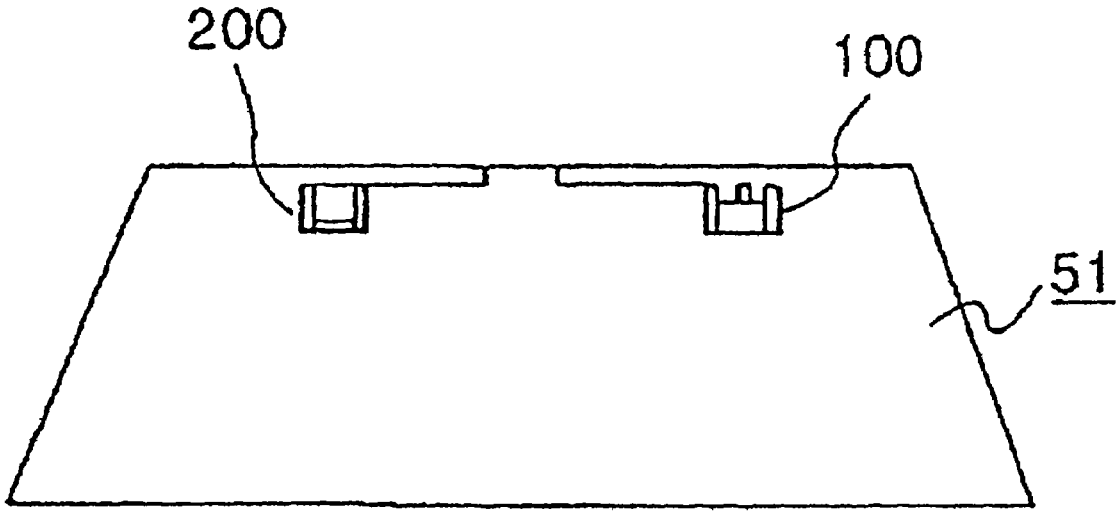
FIG. 17B PRIOR ART
FIG. 17B is a plan view of a rear glass observed from a vehicle interior.

Then, one embodiment of an indirect-feeding type of an on-board antenna device for a vehicle is concretely described. FIG. 10 is a perspective view showing an electronic circuit unit provided for an on-board antenna device in accordance with one embodiment of the present invention. FIG. 11 is a perspective view showing the condition removed a cover of an electronic circuit unit provided for an on-board antenna device in accordance with one embodiment of the present invention. FIG. 12 is an exploded perspective view of an electronic circuit unit in accordance with one embodiment of the present invention. FIG. 13 is a plan view showing an electronic circuit unit omitted a part thereof in accordance with one embodiment of the present invention. FIG. 14 is a cross-sectional view of the electronic circuit unit along the line VII-VII' in accordance with one embodiment of the present invention. FIG. 15 is a plan view of a circuit board in accordance with one embodiment of the present invention. FIG. 16 is a plan view of a feeding board in accordance with one embodiment of the present invention.

As shown in FIGS. 10-16, the electronic circuit unit 304 comprises: a base plate 305 including a square-shaped opening 305*a*; a frame 306 including a square-shaped opening 306*a* with a substantial identical shape with respect to the opening 305*a*; a feeding board 307 and a circuit board 308 which are arranged in mutually parallel within the opening 306*a* of the frame 306; a small connection board 309 arranged between the feeding board 307 and the circuit board 308 in a vertical direction to the feeding board and the circuit board; a cover for covering the frame 306 to wrap over the opening 306*a*; and a pair of fixing screws 311 for fixing the frame 306 to the base plate 305, the frame 306 being detachable from the base plate 305 by detaching the fixing screws. A housing 312 of the electronic circuit unit 304 is composed of the frame 304 and the cover 310 for containing the feeding board 307, the circuit board 308, the small connection board 309 and so on.

As shown in FIG. 12, first supporting portions 313 are formed on the frame 306 to define the height position of the feeding board 307, and the surrounding edge of the feeding board 307 is tightly fixed by the first supporting portions 313 and first tongues 315 in the direction of the thickness of the feeding board 307. As the first supporting portions 313 and the first tongues 315 are bent in the direction of the inside of the electronic circuit unit 304, through-holes 319 are designed into the frame 306. Second supporting portions 314 are formed on the frame 306 to define the height position of the circuit board 308, and the surrounding edge of the circuit board 308 is tightly fixed by the second supporting portions 314 and second tongues 316 in the direction of the thickness of the circuit board 308. As the second supporting portions 314 and the second tongues 316 of sidewalls 306*b* are bent in the direction of the inside of the electronic circuit unit 304, through-holes 320 are designed into the frame 306. The height of the circuit board 308 is defined by receiving-portions 317 formed in the four corners of the opening 306*a* as well as the second supporting portions 314, and each of the receiving-portions 317 is a receiving side for supporting the four corners of the circuit board 308. In addition, a plurality of apertures 321 which function as water-pulling out holes are designed into the frame 306 to pass through water from internal space to external space thereof, and the apertures 321 may be designed in the lower side of sidewalls 306*b*, where the lower side means the downward region of the on-board antenna device formed on the window glass 51.

It is further described with regard to the frame 306. The frame 306 is substantially composed of four sidewalls 306*b* for containing the square-shaped opening 306*a*, and of a pair of outwardly protruded portions 306*c*, which are protruded from each of sidewalls 306*b* mutually opposed. Each of the outwardly protruded portions 306*c* are formed in the location corresponding to each of outwardly protruded portions 305*b* of the base plate 305, and through-holes 306*d* are designed into the outwardly protruded portions 306*c* to pass through fixing screws 311, respectively. The first supporting portions 313 and the second supporting portions 314 are bent from the sidewalls 306*b* toward the inside of the frame 306. The first tongues 315 and the second tongues 316 are bent from the sidewalls 306*b* toward the inside of the frame 306 at the neighboring portion of the supporting portions 313 and 314. The receiving portions 317 are successively contacted to the neighboring sidewalls of the frame 306 in four corners of the opening 306*a*. Guiding portions 318 are designed into the frame 306, the guiding portions 318 standing from the root portions of outwardly protruded portions 306*c* and from the top of receiving portions 317, respectively.

The feeding board 307 supported in the frame 406 is closely arranged to the window glass 51, and one surface (the opposite surface to the glass 51) of the feeding board 307 is a pattern forming surface 307*a* having the feeding pattern 322 and the feeding pattern 323. The pattern forming surface 307*a* is mainly arranged in the location opposed to the radiation element 302. A connection hole 307*b* is designed between the feeding pattern 322 and the feeding pattern 323 of the feeding board 307 to pass through the one end of the small connection board 309.

The circuit board 308 is supported in the frame 306 to be opposed to the feeding board 307 keeping a predetermined distance. One surface (the opposite surface to the feeding board 307) of the circuit board 308 is an electromagnetic wave reflecting surface 308*a* provided with a conductive layer in substantial entire area thereof. The other surface of the circuit board 308 is a component mounting surface 308*b* provided with a pre-amplifier 325 as a part of components. As shown in FIG. 12, a connection hole 308*c* is designed into the circuit board 308 to pass through the other end of the small connection board 309. A plurality of aligning holes 308*d* are designed into the surrounding edge of the circuit board 308 to pass through the guiding portions 318 of the frame 306, and protrusions 308*e* are designed into the circuit board 308 in the location corresponding to the root portion of the outwardly protruded portions 306*c* of the frame 306, respectively. Moreover, a notched portion 308*f* of relatively large depression-shape is provided for the circuit board 308 in the location corresponding to the assembling position of a connector 324.

The small connection board 309 is arranged between the feeding board 307 and the circuit board 308 in a vertical direction of these boards to pass through the each end of these boards to each of the connection holes 307*b* and 308*c*, respectively. The transmission routes (i.e. one or more lines for electrically connecting the feeding board 307 to the circuit board 308, which are not shown in FIGS. 10-16), for example micro-strip lines, are formed on the one surface of the small connection board 309. Ground lines 327 are formed on the other surface of the small connection board 309. Each one end of the micro-strip lines toward the feeding board 307 are soldered into the feeding pattern 322, and each one end of the ground lines 327 toward the feeding board 307 are soldered into the feeding pattern 323, and each of the other end of the ground lines 327 toward the circuit board 308 are soldered into a terminal of the pre-amplifier 325, respectively. As a result, the feeding board 307 and the circuit board 308 are electrically connected.

Thus, after the cover 310 has been covered on the frame 306 to wrap over the component mounting surface 308*b* of the circuit board 308, the frame 306 is arranged into the opening

305*a* of the base plate 305 fixed to the window glass 51 in the vehicle interior. In that case, the outwardly protruded portions 306*c* are overlapped to the outwardly protruded portions 305*b*, and the through-holes 306*d* of the frame 306 are fixed to the female screws 305*c* of the base plate 305 by clamping with the fixing screws 311, respectively. In this manner, the electronic circuit unit 304 is formed on the window glass 51 by assembling the frame 306 to the base plate 305. Thereby, the feeding pattern 322 is closely opposed to the radiation element 302 and the ground element 303, and the feeding pattern 323 is closely opposed to the ground element 303. Therefore, connecting a coaxial cable from a receiver (not shown) to the connector 324, the feeding pattern 322 is electro-magnetically coupled to the radiation element 302 and the ground element 303, and the feeding pattern 323 is electro-magnetically coupled to the ground element 303, whereby the indirect-feeding for receiving the broadcast wave may be implemented.

In that case, the base plate having the leakage prevention walls (305*d*, 305*e*, 305*f* and 305*g*), which is one feature of the present invention, is schematically shown in FIGS. 13 and 14.

The important reference numerals indicating dimensions ($a_1$, $a_2$, $b_1$, $b_2$, c, and d) in the method for defining the leakage prevention walls of the base plate, which are features of the present invention, are shown in FIGS. 13 and 14. It should be understood that the actual dimensions of reference numerals shown in FIGS. 13 and 14 do not need to be same as values for ones shown in FIG. 2. It is fixed like reference numerals as similar elements for the convenience of the explanation.

That is, the width c and the length d of the frame 306 are shorter than a wavelength of a receiving frequency band of the on-board antenna device and are also longer than ⅕ of the wavelength, and the distances $a_1$ and $a_2$ between the frame 306 and the leakage prevention walls of the base plate 305 are 0.6% or less of the wavelength. Suitably, the distances $a_1$ and $a_2$ are 0.3% or less of the wavelength.

Moreover, the heights $b_1$ and $b_2$ of the leakage prevention walls are defined by 3% or more of the wavelength. Suitably, the heights $b_1$ and $b_2$ are defined by 6% or more of the wavelength.

Moreover, since the aperture 321 of the frame 306 formed on the window glass 51 and the aperture 305*j* designed into the base plate 305 are provided for the on-board antenna device, the water of internal space of the on-board antenna device may be immediately pulled out to the external thereof (as shown in FIG. 12). In that case, the maximum length of each aperture 305*j* designed into the leakage prevention walls is ¼ or less of a wavelength of a receiving frequency band of the on-board antenna device, and the area of at least one of the apertures is larger than the area of the circle of 2 mm in the diameter, and is 1.5% or less of the square-value of the wavelength.

According to the second embodiment, the on-board antenna device contains the feeding board 307 electrically connected to the circuit board 308 through the small connection board 309 in the space surrounded by the frame 306 (or housing 312). Moreover, since the feeding board 307 is closely opposed to the inner-surface of the rear glass (i.e. the surface of the window glass 51 in the vehicle interior), the indirect-feeding type of the on-board antenna device may be implemented by electro-magnetically coupling the feeding pattern 322 to the radiation element 302 without depending on the condition of the electrical connection between the frame and the base plate which are provided for the on-board antenna device.

Therefore, in accordance with the second embodiment, the on-board antenna device for reducing the variation of the antenna performance and for stabilizing the antenna performance to be high quality may be provided without depending on the condition of the electrical connection between the frame and the base plate. In addition, an excessive inspection process which increases cost of the on-board antenna device need not be worked. Thereby, the manufacturing efficiency may be raised and the effect of reduction in costs may be expected in the on-board antenna device. Moreover, if the aperture of the leakage prevention walls is designed therein according to the method for defining the leakage prevention walls, the aperture may suitably function for pulling out undesired water to outside thereof even if the leakage prevention walls are provided for the on-board antenna device, like the conventional on-board antenna device.

While the present invention has been described and illustrated with reference to specific exemplary embodiments, it should be understood that many modifications and substitutions could be made without departing from the spirit and scope of the invention. For example, while it is described in the embodiments that the leakage prevention walls have plane-shape, the leakage prevention walls may have uneven-shape. Alternatively, while it is described in the embodiments that each surface of the leakage prevention walls has a surface substantially parallel to each of the sidewalls of the frame, the substantial parallel surface may include a tolerance with range according to the above-mentioned method for defining the leakage prevention walls. In addition, while it is described in the embodiments that the receiving frequency band of the on-board antenna device is for the satellite, the present invention does not set a limit for the frequency band. Moreover, while it is described in the embodiments that the on-board antenna device is formed on the rear glass, the on-board antenna device may be fixed on a window shield or side-window glass of the vehicle. "Square-shaped frame", "base plate" and "leakage prevention walls" may be made from non-metallic materials, such as a resin or a glass, with electrical conductive coating coated on the surfaces thereof or with metallic micro-particles contained in the non-metallic materials. Accordingly, the present invention is not to be considered as limited by the foregoing description but is only limited by the scope of the appended claims.

The invention claimed is:

1. An on-board antenna device, comprising:

a radiation element formed on an inner-surface of a window glass for a vehicle;

a base plate having an opening, the base plate being fixed on the inner-surface of the window glass so as to surround the radiation element; and a housing assembled onto the base plate, the housing having an opening surrounding the radiation element;

wherein the base plate has four leakage prevention walls and each thereof has a surface substantially parallel to and spaced apart from a respective one of four sidewalls of the housing.

2. An on-board antenna device for indirect-feeding by electro-magnetically coupling a feeding pattern to a radiation element, comprising:

a radiation element formed on an inner-surface of a window glass for a vehicle;

a base plate having an opening, the base plate being fixed on the inner-surface of the window glass so as to surround the radiation element;

a feeding board having a feeding pattern which is formed on one surface thereof, the feeding pattern being opposed with a predetermined distance to the radiation element;

a circuit board including a conductive layer formed across the substantial entire area of one surface thereof which is opposed to the feeding board and a pre-amplifier mounted on the other surface thereof;

a small connection board arranged between the feeding board and the circuit board in a vertical direction to the feeding board and the circuit board; and a housing assembled onto the base plate to contain the feeding board, the circuit board and the small connection board in a space surrounded by four sidewalls of the housing;

wherein the base plate has four leakage prevention walls and each thereof has a surface substantially parallel to each of the four sidewalls of the housing.

3. The on-board antenna device according to claim 1 or 2, wherein each distance between the four leakage prevention walls and the four sidewalls of the housing is 0.6% or less of a wavelength of a receiving frequency band of the on-board antenna device.

4. The on-board antenna device according to claim 1 or 2, wherein the height of at least one of the four leakage prevention walls is 3% or more of a wavelength of a receiving frequency band of the on-board antenna device.

5. The on-board antenna device according to claim 1 or 2, wherein at least one of the four sidewalls of the housing has at least one of first apertures and at least one of the four leakage prevention walls has at least one of second apertures, and the maximum length of the each of the at least one of second aperture is ¼ or less of a wavelength of a receiving frequency band of the on-board antenna device, and the area of each of the at least one of second aperture is larger than the area of the circle of 2 mm in the diameter, and is 1.5% or less of the square-value of the wavelength.

* * * * *